US008224222B2

(12) United States Patent
Mitsuoka

(10) Patent No.: US 8,224,222 B2
(45) Date of Patent: Jul. 17, 2012

(54) FIXING DEVICE AND IMAGE FORMING APPARATUS INCLUDING FIXING DEVICE

(75) Inventor: Tetsunori Mitsuoka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 262 days.

(21) Appl. No.: 12/785,534

(22) Filed: May 24, 2010

(65) Prior Publication Data

US 2010/0303527 A1 Dec. 2, 2010

(30) Foreign Application Priority Data

May 28, 2009 (JP) ..... 2009-129584

(51) Int. Cl.
*G03G 15/20* (2006.01)

(52) U.S. Cl. ..... 399/329; 399/122

(58) Field of Classification Search ..... 399/38, 399/67–70, 122, 320, 328, 329; 219/216, 219/619

See application file for complete search history.

(56) References Cited

U.S. PATENT DOCUMENTS

| | | | | |
|---|---|---|---|---|
| 6,243,559 | B1 | 6/2001 | Kurotaka et al. | |
| 7,103,307 | B2 * | 9/2006 | Aruga et al. | 399/328 |
| 7,548,718 | B2 | 6/2009 | Kubota et al. | |
| 7,912,413 | B2 * | 3/2011 | Murakami | 399/329 |
| 7,917,075 | B2 * | 3/2011 | Sone et al. | 399/329 |
| 2005/0276624 | A1 | 12/2005 | Fujino | |
| 2006/0210288 | A1 | 9/2006 | Hayashi et al. | |

FOREIGN PATENT DOCUMENTS

| | | | |
|---|---|---|---|
| JP | 07-263122 | A | 10/1995 |
| JP | 10-307496 | A | 11/1998 |
| JP | 2002-333788 | A | 11/2002 |
| JP | 2004-177888 | A | 6/2004 |
| JP | 2005-352389 | A | 12/2005 |
| JP | 2006-072182 | A | 3/2006 |
| JP | 2006-259330 | A | 9/2006 |
| JP | 2008-040442 | A | 2/2008 |
| JP | 11-016667 | A | 1/2009 |

* cited by examiner

*Primary Examiner* — Hoan Tran

(74) *Attorney, Agent, or Firm* — Renner, Otto, Boisselle & Sklar, LLP

(57) ABSTRACT

A fixing device is provided. In a fixing device, a heating member that heats a fixing belt includes a heat generating member that has a heat generating layer that generates heat due to being energized, and a heat radiating member. In the heat radiating member, a heat receiving piece of a first heat radiating section and a heat receiving piece of a second heat radiating section are combined with each other to form a heat receiving section, and a heat transfer piece of the first heat radiating section and a heat transfer piece of the second heat radiating section are combined with each other to form a heat transfer section. Heat pipes that are meandering capillary tube heat pipes are formed inside the first heat radiating section and the second heat radiating section.

20 Claims, 17 Drawing Sheets

FIXING DEVICE AND IMAGE FORMING APPARATUS INCLUDING FIXING DEVICE

CROSS-REFERENCE TO RELATED APPLICATION

This application claims priority to Japanese Patent Application No. 2009-129584, which was filed on May 28, 2009, the contents of which are incorporated herein by reference in its entirety.

BACKGROUND OF THE INVENTION

1. Field of the Invention

The present invention relates to a fixing device that fixes a toner image onto a recording medium by the action of heat and pressure, and to an image forming apparatus including the fixing device.

2. Description of the Related Art

As a fixing device for use in an electrophotographic image forming apparatus such as a copying machine and a printer, a fixing device of heat-roller fixing type has been in wide use. The fixing device of heat-roller fixing type includes a pair of rollers (a fixing roller and a pressure roller) that are brought into contact with each other under pressure. By means of a heating section composed for example of a halogen lamp, which is placed in each of or one of the pair of rollers interiorly thereof, the pair of rollers are heated to a predetermined temperature (fixing temperature). With the pair of rollers kept in a heated state, such as a recording paper sheet, which is a recording medium having formed thereon an unfixed toner image, is fed to a region where the pair of rollers make pressure-contact with each other (a fixing nip region). Upon the recording paper sheet passing through the pressure-contact region, the toner image is fixed to the recording paper sheet under application of heat and pressure.

Incidentally, a fixing device for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixing on the unfixed color toner image that is larger in toner adherent amount than a monochromatic toner image. Moreover, by virtue of a deflection-releasing effect exerted by the elastic layer in the fixing nip region, it is possible to provide enhanced releasability for a color toner that is more susceptible to occurrence of offset than a monochromatic toner. Further, since the fixing nip region is convexly curved in a radially-outward direction so as to define a so-called reverse nip configuration, it is possible to attain higher paper-stripping capability. That is, a paper stripping action can be produced without using a stripping portion such as a stripping pawl (self-stripping action), wherefore image imperfection caused by the provision of the stripping portion can be eliminated.

Incidentally, in such a fixing device provided in a color image forming apparatus, it is necessary to make a nip width of the fixing nip region wide in order to correspond to increase in speed. One available method of increasing the fixing nip width is to increase the thickness of the elastic layer of the fixing roller and the diameter of the fixing roller. However, in a fixing roller having an elastic layer, the elastic layer can not sufficiently conduct heat, thus, in a case where a heating section is provided inside the fixing roller, there is a problem that a temperature of the fixing roller is not followed when a process speed is increased. On the other hand, when a diameter of the fixing roller is increased, there is a problem that it takes longer time to warm up or power consumption is increased.

As a fixing device provided in a color image forming apparatus to solve such problems, Japanese Unexamined Patent Publication JP-A 10-307496 (1998) discloses a fixing device of belt fixing type that is configured so that a fixing belt is supported around a fixing roller and a heating roller and the fixing roller and a pressure roller are brought into pressure-contact with each other with the fixing belt interposed therebetween. In the fixing device of belt fixing type, since the fixing belt with a small heat capacity is heated, it takes short time to warm up and it is not necessary to incorporate a heat source such as a halogen lamp in the fixing roller, thus making it possible to provide a thick elastic layer with low hardness formed of sponge rubber and the like and to secure a wide nip width.

Furthermore, Japanese Unexamined Patent Publication JP-A 2002-333788 discloses a fixing device of planar heat generating belt fixing type with a heating section as a planar heat generating element. In the fixing device of planar heat generating belt fixing type, when a heat capacity of the heating section is reduced, the planar heat generating element as the heating section directly generates heat at the same time, thus a thermal response speed is also enhanced compared to a system in which a heating roller is heated indirectly using a halogen lamp or the like and it is possible to attain further shortening of a time for warm up and more energy saving.

Japanese Unexamined Patent Publication JP-A 2006-72182 describes a fixing device of belt fixing type in which a fixing belt is supported around a fixing roller and a heating member, and the fixing roller and a pressure roller are brought into pressure-contact with each other through the fixing belt. The heating member includes a heat generating member, and a heat radiating member that transfers heat generated by the heat generating member to the fixing belt so as to heat the fixing belt. A heat pipe having a heat transport function is arranged close to the heat radiating member.

With the fixing device disclosed in JP-A 2006-72182, recording paper sheets of a small-width size pass successively through a fixing nip region, and when a paper non-passing region of the fixing belt is heated, heat of a region of the heat radiating member corresponding to the heated paper non-passing region of the fixing belt is transported through the heat pipe. Therefore, the difference in temperature on surface of the heat radiating member in the axial direction thereof is eliminated and local overheating is suppressed, such that stable image quality can be ensured. That is, in the fixing device disclosed in JP-A 2006-72182, with respect to the difference in temperature of the heat radiating member in the axial direction thereof, the heat pipe that is arranged to be in contact with the heat radiating member transports heat from the paper non-passing region at high temperature to a region at low temperature by a heat transport mechanism of the heat pipe. Therefore, the difference in temperature on the surface of the heat radiating member in the axial direction thereof is eliminated, and the fixing belt has a uniform temperature distribution in the width direction thereof. As a result, defective image quality, such as wrinkling or gloss irregularity, due to the difference in temperature can be suppressed.

In the fixing device disclosed in JP-A 2006-72182, the difference in temperature on the surface of the heat radiating member in the axial direction thereof can be eliminated; however, when the heat generating member does not heat the entire surface of the heat radiating member, the difference in temperature of the heat radiating member in the circumferential direction thereof (the rotation direction of the fixing belt) may not be eliminated, which results in deterioration in the heating efficiency of the heat radiating member for the fixing belt. The difference in temperature of the heat radiating member in the circumferential direction thereof causes an uneven temperature distribution in the circumferential direction thereof over the region of the fixing belt in contact with the heat radiating member. As a result, defective fixing occurs, which results in defective image quality, such as gloss irregularity.

In the fixing device, to reduce the warm-up time, when the heat radiating member is configured to have a low heat capacity and a high-power-density heat generating member is used, the temperature rising rate of the heat generating member increases. For this reason, unevenness of the temperature distribution on the surface of the Cheat radiating member in the circumferential direction thereof as well as the axial direction thereof becomes conspicuous. As a result, defective fixing may occur.

When a heat generating member formed of a high-power-density resistance heat generating element, which is represented by a ceramic heat generating element, is used, the difference between the temperature of the resistance heat generating element (heat generating member) itself and the temperature of the heat radiating member or the fixing belt tends to increase. When the difference in temperature extremely increases, self-suppression of energization may occur in the resistance heat generating element due to an increase in electrical resistance of the resistance heat generating element or the resistance heat generating element may be damaged due to thermal shock.

In the fixing device disclosed in JP-A 2006-72182, when the heat generating member is configured such that a resistance heat generating element forms a predetermined surface, the heat radiating member is arranged to be in contact with one surface in the thickness direction thereof from among a plurality of surfaces of the heat generating member. For this reason, in the heat generating member, there is no case where heat is lost from other surfaces which are not in contact with the heat radiating member. Accordingly, the resistance heat generating element is likely to be in an overheated state. When the resistance heat generating element is in the overheated state, self-suppression of energization occurs in the resistance heat generating element undergoes due to an increase in electrical resistance of the resistance heat generating element, such that continuous heat generation is not carried out in the heat generating member. Then, heat generation of the heat generating member becomes unstable, and heat generation efficiency is deteriorated. When the heat generation efficiency of the heat generating member is deteriorated, the warm-up time of the fixing device is extended.

SUMMARY OF THE INVENTION

An object of the invention is to provide a fixing device of belt fixing type that uses heat of a resistance heat generating element that generates heat due to being energized to heat a fixing belt, having advantages of obtaining a high-quality fixed image with a uniform temperature distribution in the width and circumferential directions of a fixing belt, achieving stable heat generation by a resistance heat generating element to prevent deterioration of heat generation efficiency, and reducing a warm-up time, and an image forming apparatus including the fixing device.

The invention provides a fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a heat generating member that has a heat generating layer composed of a resistance heat generating element that generates heat due to being energized; and a heat radiating member that radiates heat generated by the heat generating member to the fixing belt, the heat radiating member having:

a heat receiving section that is provided to be in contact with a plurality of surfaces of the heat generating member and receive heat generated by the heat generating member; and a heat transfer section that is provided to be curved along the inner circumferential surface of the fixing belt and transfers heat received by the heat receiving sections to the fixing belt, and inside the heat receiving section and the heat transfer section, a heat transport section being provided to transport heat received by the heat receiving section toward the heat transfer section in a width direction and a circumferential direction of the fixing belt.

According to the invention, in the fixing device, the heating member that heats the fixing belt includes the heat generating member that has the heat generating layer composed of the resistance heat generating element that generates heat due to being energized, and the heat radiating member that has a heat transport section. The heat radiating member includes a heat receiving section that is provided to be in contact with a plurality of surfaces of the heat generating member and receives heat generated by the heat generating member, and the heat transfer section that transfers heat received by the heat receiving section to the fixing belt.

In the fixing device thus configured, heat received by the heat receiving section of the heat radiating member provided in contact with a plurality of surfaces of the heat generating member is transported in the width direction and the circumferential direction of the fixing belt by the heat transport section, and is then transferred from the heat transfer section of the heat radiating member to the fixing belt, thereby heating the fixing belt. For this reason, a uniform temperature distribution in the width direction and the circumferential direction of the fixing belt can be achieved, such that a high-quality fixed image can be obtained.

The heat receiving section of the heat radiating member is provided to be in contact with a plurality of surfaces of the heat generating member and receives heat generated by the heat generating member. For this reason, heat receiving efficiency can be increased, and the resistance heat generating element forming the heat generating layer can be prevented from being in an overheated state. Therefore, self-suppression of energization can be prevented from occurring in the resistance heat generating element, and accordingly heat generation by the resistance heat generating element can be continuously and stably carried out to prevent heat generation efficiency from being deteriorated, and a warm-up time of the fixing device can be reduced.

Further, in the invention, it is preferable that the heat transport section includes a meandering capillary tube heat pipe in which a capillary tube filled with a heat transport fluid is repeatedly bent to form a predetermined surface, and the capillary tube includes linear portions that extend linearly, and connection portions that connect ends of adjacent linear portions in an extension direction of the linear portion to form a single line.

According to the invention, the heat transport section of the heat radiating member includes the meandering capillary tube heat pipe in which the capillary tube filled with the heat transport fluid is repeatedly bent to form a predetermined surface. The heat transport section that includes the meandering capillary tube heat pipe can transport heat received by the heat receiving section in the width direction and the circumferential direction of the fixing belt with high efficiency. The meandering capillary tube heat pipes can stably transport heat since there is little increase/decrease in heat transport capability due to arrangement position or a difference in the extension direction (heat transport direction) of the heat pipe, as compared with a general heat pipe. For this reason, even when a heat transport route is complicated or a large number of bends are provided, the heat transport section including the meandering capillary tube heat pipe can stably transport heat. Therefore, heat transport to the heat radiating member can be efficiently carried out, and heating efficiency of the fixing belt can be improved.

Further, in the invention, it is preferable that the heat receiving section is provided to be in contact with two surfaces having a larger area in descending order from among surfaces constituting the heat generating member and to sandwich the heat generating member.

According to the invention, the heat receiving section of the heat radiating member is provided to be in contact with two surfaces having a larger area in descending order from among the surfaces constituting the heat generating member and to sandwich the heat generating member. Therefore, the heat receiving efficiency of the heat receiving section, which receive heat generated by the heat generating member, can be increased, heat generation by the resistance heat generating element can be continuously and stably carried out, and the resistance heat generating element can be prevented from being in an overheated state and then damaged or burned out.

Further, in the invention, it is preferable that the heat radiating member includes a plurality of heat radiating sections having the heat transport section, and the plurality of heat radiating sections each include a heat receiving piece that receives heat generated by the heat generating member, the heat receiving pieces of the plurality of heat radiating sections being provided to be in contact with different surfaces of the heat generating member, the plurality of heat radiating sections each include a heat transfer piece that is provided to be curved along the inner circumferential surface of the fixing belt and transfers heat received by the heat receiving pieces to the fixing belt, and the heat receiving pieces of the plurality of heat radiating sections are combined with each other to form the heat receiving section, and the heat transfer pieces of the plurality of heat radiating sections are combined with each other to form the heat transfer section.

According to the invention, the heat radiating member includes a plurality of heat radiating sections having the heat transport section. The plurality of heat radiating sections each include a heat receiving piece that receives heat generated by the heat generating member, and the heat receiving pieces of the plurality of heat radiating sections are provided to be in contact with different surfaces of the heat generating member. The plurality of heat radiating sections each further include a heat transfer piece that transfers heat received by the heat receiving pieces to the fixing belt. The heat receiving pieces of the plurality of heat radiating sections are combined with each other to form the heat receiving section, and the heat transfer pieces are combined with each other to form the heat transfer section. Therefore, a heat radiating member that includes a heat receiving section provided to be in contact with a plurality of surfaces of the heat generating member and the heat transfer section provided to be curved along the inner circumferential surface of the fixing belt can be formed with simple configuration.

Further, in the invention, it is preferable that a heat generating region of the resistance heat generating element is of a planar shape.

According to the invention, the heat generating region of the resistance heat generating element is of a planar shape. Therefore, heat transfer efficiency in transfer of heat of the resistance heat generating element generated due to energization to the heat receiving section of the heat radiating member can be improved.

Further, in the invention, it is preferable that the resistance heat generating element is a ceramic heat generating element.

According to the invention, the resistance heat generating element is a ceramic heat generating element. The ceramic heat generating element is a heat generating element that can realize high power density. Therefore, the heat generating member including the ceramic heat generating element has high heating capability with respect to the heat receiving section of the heat radiating member.

Further, in the invention, it is preferable that the resistance heat generating element has a positive resistance-temperature property in which, as temperature rises, electric resistance increases.

According to the invention, the resistance heat generating element has a positive resistance-temperature property. In the case of a resistance heat generating element having a positive resistance-temperature property, as temperature rises, electrical resistance increases. When a resistance heat generating element having a positive resistance-temperature property is heated to be equal to or higher than a predetermined temperature, electrical resistance rapidly increases and the amount of current decreases, such that the resistance heat generating element is prevented from being in an overheated state. In the case of a resistance heat generating element having a positive resistance-temperature property, as temperature rises, the amount of current decreases, such that power consumption can be reduced and power savings can be realized. The heat generating member including the resistance heat generating element is configured such that a plurality of surfaces from among the surfaces constituting the heat generating member are provided to be in contact with the heat receiving section of the heat radiating member having the heat transport section. For this reason, even when the resistance heat generating element is a heat generating element having a positive resistance-temperature property, a uniform temperature distribution on the surface of the heat transfer section of the heat radiating member is achieved, and a uniform temperature distribution in the width direction and the circumferential direction of the fixing belt is achieved. Therefore, heat generation by the resistance heat generating element is stably carried out, and thus heat generation efficiency is prevented from being deteriorated.

Further, in the invention, it is preferable that the resistance heat generating element has a negative resistance-temperature property in which, as temperature rises, electrical resistance decreases.

According to the invention, the resistance heat generating element has a negative resistance-temperature property. In the resistance heat generating element having a negative resistance-temperature property, as temperature rises, electrical resistance decreases. The heat generating member including the resistance heat generating element is configured such that a plurality of surfaces from among the surfaces constituting the heat generating member are provided to be in contact with the heat receiving section of the heat radiating member having the heat transport section. For this reason, even when the resistance heat generating element is a heat generating element having a negative resistance-temperature property, a uniform temperature distribution on the surface of the heat transfer section of the heat radiating member is achieved, and a uniform temperature distribution in the width direction and the circumferential direction of the fixing belt is achieved. Therefore, heat generation by the resistance heat generating element is stably carried out, and thus heat generation efficiency is prevented from being deteriorated.

Further, in the invention, it is preferable that the resistance heat generating element has a positive resistance-temperature property and a negative resistance-temperature property.

According to the invention, the resistance heat generating element has a positive resistance-temperature property and a negative resistance-temperature property. The heat generating member including the resistance heat generating element is configured such that a plurality of surfaces from among the surfaces constituting the heat generating member are provided to be in contact with the heat receiving section of the heat radiating member having the heat transport section. For this reason, even when the resistance heat generating element is a heat generating element having a positive resistance-temperature property and a negative resistance-temperature property, a uniform temperature distribution on the surface of the heat transfer section of the heat radiating member is achieved, and a uniform temperature distribution in the width direction and the circumferential direction of the fixing belt is achieved. Therefore, heat generation by the resistance heat generating element is stably carried out, and thus heat generation efficiency is prevented from being deteriorated.

Further, in the invention, it is preferable that the heat generating layer has a plurality of rectangular resistance heat generating elements arranged in the width direction of the fixing belt.

According to the invention, the heat generating layer of the heat generating member has a plurality of rectangular resistance heat generating elements arranged in the width direction of the fixing belt. Therefore, heat generating layer that has a heat generating surface in a predetermined shape as a whole can be formed with simple configuration.

Further, in the invention, it is preferable that the heat generating member has a plurality of heat generating layers having a plurality of rectangular resistance heat generating elements arranged in the width direction of the fixing belt with an intermediate layer interposed therebetween, and the resistance heat generating elements constituting the plurality of heat generating layers are arranged in a staggered manner when viewed from a direction orthogonal to the width direction of the fixing belt.

According to the invention, the heat generating member includes a plurality of heat generating layers having a plurality of rectangular resistance heat generating elements arranged in the width direction of the fixing belt. When the resistance heat generating elements constituting the plurality of heat generating layers are arranged in a staggered manner when viewed from the direction orthogonal to the width direction of the fixing belt. Therefore, the heat generation distribution on the surface of the heat generating member can be adjusted to a desired distribution, and the heating capability of the heat radiating member with respect to a specific region of the fixing belt can be controlled.

Further, in the invention, it is preferable that the heat transport section is configured by a combination of two or more meandering capillary tube heat pipes selected from the group consisting of a meandering capillary tube heat pipe in which the extension direction of the linear portions is in parallel to the width direction of the fixing belt, a meandering capillary tube heat pipe in which the extension direction of the linear portions is orthogonal to the width direction of the fixing belt, and a meandering capillary tube heat pipe in which the extension direction of the linear portions is inclined at a predetermined angle in the width direction of the fixing belt.

According to the invention, the heat transport section is configured by a combination of a plurality of meandering capillary tube heat pipes. The meandering capillary tube heat pipes constituting the heat transport section are two or more heat pipes selected from the group consisting of a heat pipe in which the extension direction of the linear portions is in parallel to the width direction of the fixing belt, a heat pipe in which the extension direction of the linear portions is orthogonal to the width direction of the fixing belt, and a heat pipe in which the extension direction of, the linear portions is inclined at a predetermined angle in the width direction of the fixing belt. When the heat transport section is configured by the combination of two or more meandering capillary tube heat pipes, which are different in the extension direction of the linear portions, heat generated at a point, a line, or a small surface of each resistance heat generating element of the heat generating member can be efficiently transported in the width direction and the circumferential direction of the fixing belt, and the heating efficiency of the heat radiating member with respect to the fixing belt can be improved.

Further, in the invention, it is preferable that a slide easing layer that reduces frictional resistance to the fixing belt is provided on a surface of the heat transfer section that is in contact with the fixing belt.

According to the invention, the slide easing layer that reduces frictional resistance to the fixing belt is provided on the surface of the heat transfer section of the heat radiating member that is in contact with the fixing belt. Therefore, the frictional force between the heat transfer section and the fixing belt can be reduced, and thus the fixing belt can smoothly rotate.

Further, in the invention, it is preferable that the slide easing layer is formed of a material having a low friction coefficient and satisfactory thermal conductivity.

According to the invention, the slide easing layer is formed of a material having a low friction coefficient and satisfactory thermal conductivity. Therefore, the heat transfer efficiency of the heat transfer section with respect to the fixing belt can be prevented from being deteriorated, and thus the fixing belt can smoothly rotate.

Further, in the invention, it is preferable that the second fixing member includes a pressure belt that is an endless-shaped belt that is supported around a pressure member and a support member with tension to be rotatable, and the pressure member is provided to be opposite to the first fixing member with the fixing belt and the pressure belt interposed therebetween.

According to the invention, the second fixing member includes the pressure belt that is an endless-shaped belt that is supported around the pressure member and the support member with tension. The pressure member is provided to be opposite to the first fixing member with the fixing belt and the pressure belt interposed therebetween, and the fixing nip region is formed at a region where the fixing belt and the pressure belt are in contact with each other. Therefore, a wide fixing nip region can be obtained without causing an increase in the size of the device, and defective fixing can be suppressed.

Further, the invention provides a fixing device of two-stage fixing type comprising:

a first fixing section that performs primary fixing of a toner image borne on a recording medium to be conveyed onto the recording medium under application of heat and pressure; and a second fixing section that is arranged on a downstream side in a conveyance direction of the recording medium with respect to the first fixing section, and performs secondary fixing of the toner image after the primary fixing onto the recording medium under application of heat and pressure, the first fixing section and the second fixing section being the fixing device described above.

According to the invention, the fixing device of two-stage fixing type includes the first fixing section that performs primary fixing of a toner image borne on the recording medium to be conveyed onto the recording medium under application of heat and pressure, and the second fixing section that is arranged on a downstream side in a conveyance direction of the recording medium with respect to the first fixing section, and performs secondary fixing of the toner image after the primary fixing onto the recording medium under application of heat and pressure. The first fixing section and the second fixing section are the above-described fixing device that includes the heating member configured such that the heat radiating member having the heat transport section is provided to be in contact with the plurality of surfaces of the heat generating member. In the fixing device of two-stage fixing type thus configured, when the resistance heat generating elements provided in the first fixing section and the second fixing section are energized, a uniform temperature distribution on the surfaces of the heat transfer sections of the heat radiating members provided in the first and second fixing sections is achieved, and a uniform temperature distribution in the width direction and the circumferential direction of the fixing belt is achieved. Therefore, heat generation by the resistance heat generating elements is stably carried out, and heat generation efficiency is prevented from being deteriorated. As a result, the fixing device of two-stage fixing type can obtain a high-quality fixed image and reduce the warm-up time.

Further, the invention provides a fixing device of two-stage fixing type comprising:

a first fixing section that performs primary fixing of a toner image borne on a recording medium to be conveyed onto the recording medium under application of heat and pressure; and a second fixing section that performs secondary fixing of toner image after the primary fixing onto the recording medium under application of heat and pressure, the second fixing section being configured by a pair of heating and pressure rollers that are provided with a heating section in an interior thereof, and are in pressure-contact with each other, and being arranged on a downstream side in a conveyance direction of the recording medium with respect to the first fixing section, the first fixing section being the fixing device described above.

According to the invention, the fixing device of two-stage fixing type includes a first fixing section that performs primary fixing of a toner image borne on a recording medium to be conveyed onto the recording medium under application of heat and pressure, and a second fixing section that performs secondary fixing of the toner image after the primary fixing onto the recording medium under application of heat and pressure, the second fixing section being configured by a pair of heating and pressure rollers that are provided with a heating section in an interior thereof, and are in pressure-contact with each other, and being arranged on a downstream side in a conveyance direction of the recording medium with respect to the first fixing section. The first fixing section is the above-described fixing device that includes the heating member configured such that the heat radiating member having the heat transport section is provided to be in contact with a plurality of surfaces of the heat generating member. In the fixing device of two-stage fixing type thus configured, when the resistance heat generating elements provided in the first fixing section are energized, a uniform temperature distribution on the surfaces of the heat transfer section of the heat radiating member provided in the first fixing section is achieved, and a uniform temperature distribution in the width direction and the circumferential direction of the fixing belt is achieved. Therefore, heat generation by the resistance heat generating elements is stably carried out, and heat generation efficiency is prevented from being deteriorated. As a result, the fixing device of two-stage fixing type can obtain a high-quality fixed image and reduce the warm-up time.

Further, the invention provides an image forming apparatus comprising the fixing device described above.

According to the invention, the image forming apparatus includes the fixing device that obtains a uniform temperature distribution in the width direction and the circumferential direction of the fixing belt, and stably carries out heat generation by the resistance heat generating element, thereby preventing heat generation efficiency from being deteriorated. Therefore, the image forming apparatus can cope with high-speed and form a high-quality image.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
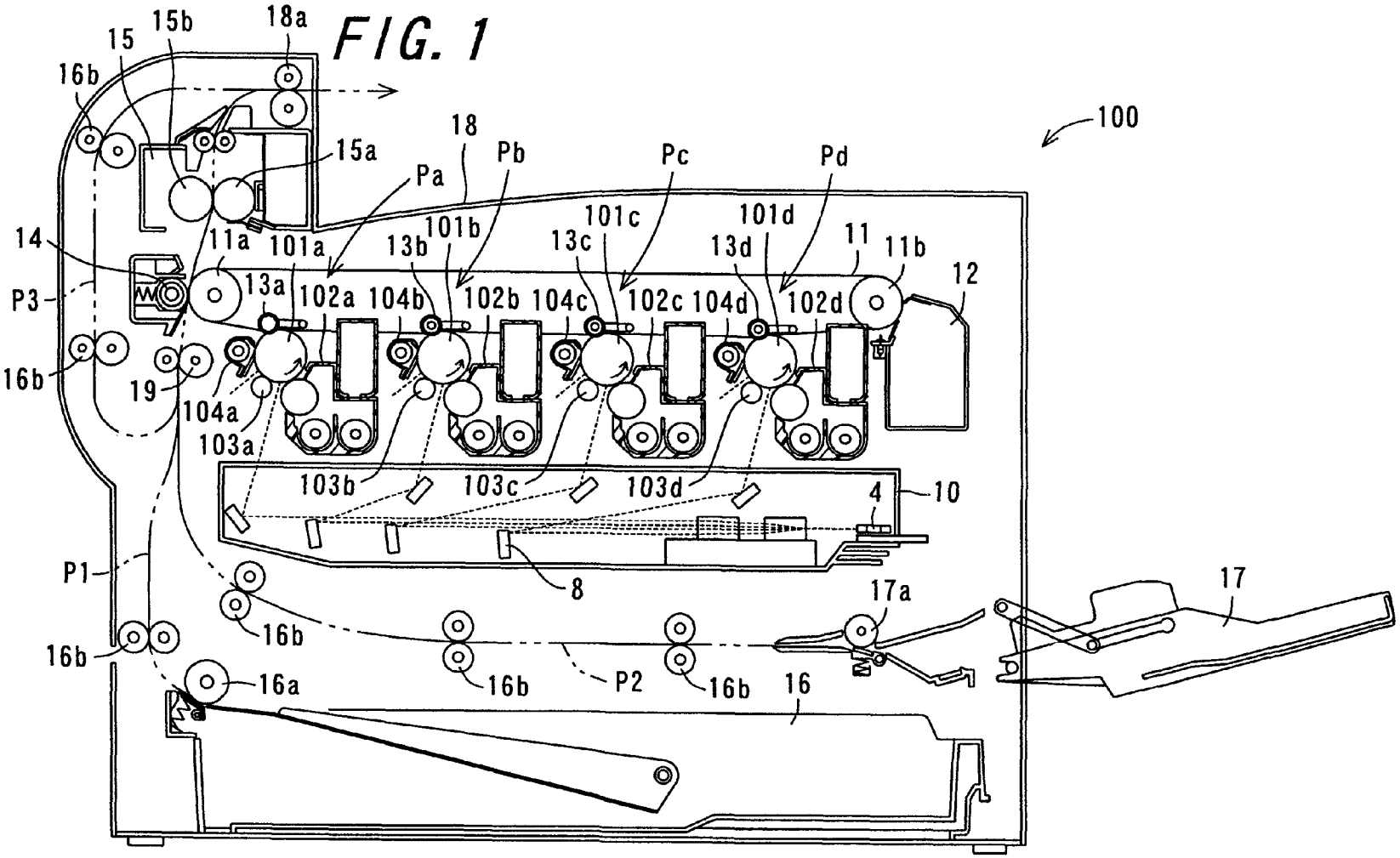
FIG. 1 is a view showing the structure of an image forming apparatus according to an embodiment of the invention.

Now referring to the drawings, preferred embodiments of the invention are described below.

FIG. 1 is a view showing the structure of an image forming apparatus 100 according to an embodiment of the invention. The image forming apparatus 100 is an apparatus that forms a color or monochrome image on a recording paper sheet based on image data read from a document or on image data transmitted through a network and the like. The image forming apparatus 100 includes an exposure unit 10, photoreceptor drums 101 (101*a* to 101*d*), developing devices 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing device 15, paper conveyance paths P1, P2, and P3, a paper feeding cassette 16, a manual paper feeding tray 17, and a catch tray 18.

The image forming apparatus 100 performs image formation by using image data corresponding to each of the four colors of black (K), as well as cyan (C), magenta (M), and yellow (Y), which are the three primary subtractive colors obtained by separating colors of a color image, in image forming sections Pa to Pd corresponding to the respective colors. The respective image forming sections Pa to Pd are similar to one another in configuration, and for example, the image forming section Pa for black (K) is constituted by the photoreceptor drum 101*a*, the developing device 102*a*, the charging roller 103*a*, the primary transfer roller 13*a*, the cleaning unit 104*a*, and the like. The image forming sections Pa to Pd are arranged in alignment along a direction in which the intermediate transfer belt 11 moves (sub-scanning direction).

The charging rollers 103 are contact-type charging devices for charging surfaces of the photoreceptor drums 101 uniformly to a predetermined potential. Instead of the charging rollers 103, contact-type charging devices using a charging brush, or noncontact-type charging devices using a charging wire is also usable.

The exposure unit 10 includes a semiconductor laser (not shown), a polygon mirror 4, a first reflection mirror 7, a second reflection mirror 8, and the like, and irradiates each of the photoreceptor drums 101*a* to 101*d* with each light beam such as a laser beam modulated according to image data of the respective colors of black (K), cyan (C), magenta (M), and yellow (Y). Each of the photoreceptor drums 101*a* to 101*d* forms thereon an electrostatic latent image corresponding to the image data of the respective colors of black (K), cyan (C), magenta (M), and yellow (Y).

The developing devices 102 supply toner as developer to the surfaces of the photoreceptor drums 101 on which the electrostatic latent images are formed, to develop the electrostatic latent images to a toner image. The respective developing devices 102*a* to 102*d* contain toner of the respective colors of black (K), cyan (C), magenta (M), and yellow (Y), and visualize the electrostatic latent images of the respective colors formed on the respective photoreceptor drums 101*a* to 101*d* into toner images of the respective colors. The cleaning units 104 remove and collect residual toner on the surfaces of the photoreceptor drums 101 after development and image transfer.

The intermediate transfer belt 11 provided above the photoreceptor drums 101 is supported around a driving roller 11*a* and a driven roller 11*b* with tension, and forms a loop-shaped moving path. An outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* with the intermediate transfer belt 11 interposed therebetween. The respective positions at which the intermediate transfer belt 11 faces the photoreceptor drums 101*a* to 101*d* are primary transfer positions. In addition, the intermediate transfer belt 11 is formed of a film having thickness of 100 to 150 μm.

A primary transfer bias having an opposite polarity to the polarity of the toner is applied under constant voltage control to the primary transfer rollers 13*a* to 13*d* in order to transfer the toner images borne on the surfaces of the photoreceptor drums 101*a* to 101*d* onto the intermediate transfer belt 11. Thus, the toner images of the respective colors formed on the photoreceptor drums 101*a* to 101*d* are transferred and overlapped onto the outer circumferential surface of the intermediate transfer belt 11 on top of each other to form a full-color toner image on the outer circumferential surface of the intermediate transfer belt 11.

Here, when image data for only a part of the colors of yellow (Y), magenta (M), cyan (C) and black (B) is inputted, electrostatic latent images and toner images are formed at only a part of the photoreceptor drums 101 corresponding to the colors of the inputted image data among the four photoreceptor drums 101*a* to 101*d*. For example, during monochrome image formation, an electrostatic latent image and a toner image are formed only at the photoreceptor drum 101*a* corresponding to black color, and only a black toner image is transferred onto the outer circumferential surface of the intermediate transfer belt 11.

The respective primary transfer rollers 13*a* to 13*d* have a structure comprising a shaft having a diameter of 8 to 10 mm, formed of a metal such as stainless steel and serving as a substrate, and a conductive elastic material (for example, EPDM or urethane foam) with which a surface of the shaft is coated, and uniformly apply a high voltage to the intermediate transfer belt 11 by the conductive elastic material.

The toner image transferred onto the outer circumferential surface of the intermediate transfer belt 11 at each of the primary transfer positions is conveyed to a secondary transfer position, which is a position facing the secondary transfer roller 14, by the rotation of the intermediate transfer belt 11. The secondary transfer roller 14 is brought into pressure-contact with, at a predetermined nip pressure, the outer circumferential surface of the intermediate transfer belt 11 whose inner circumferential surface is in contact with a circumferential surface of the driving roller 11*a* during image formation. While a recording paper sheet fed from the paper feeding cassette 16 or the manual paper feeding tray 17 passes between the secondary transfer roller 14 and the intermediate transfer belt 11, a high voltage with the opposite polarity to the charging polarity of the toner is applied to the secondary transfer roller 14. Thus, the toner image is transferred from the outer circumferential surface of the intermediate transfer belt 11 to the surface of the recording paper sheet.

Note that, of the toner attached from the photoreceptor drums 101 to the intermediate transfer belt 11, toner that has not been transferred onto the recording paper sheet and remains on the intermediate transfer belt 11 is collected by a transfer cleaning unit 12 in order to prevent color mixture in the following process.

The recording paper sheet to which the toner image is transferred is guided to a fixing device 15 described below according to an embodiment of the invention, passes through a fixing nip region, and is subjected to heat and pressure. Thus, the toner image is solidly fixed onto the surface of the recording paper sheet. The recording paper sheet onto which the toner image is fixed is discharged onto the sheet discharge tray 18 by the sheet discharge roller 18*a*.

Moreover, the image forming apparatus 100 is provided with the paper conveyance path 21 extending in the substantially vertical direction, for feeding a recording paper sheet contained in the paper feeding cassette 16 through a region between the secondary transfer roller 14 and the intermediate transfer belt 11, and by way of the fixing device 15, to the catch tray 18. The paper conveyance path P1 is provided with a pickup roller 16*a* for picking up recording paper sheets in the paper feeding cassette 16 in the paper conveyance path P1 sheet by sheet, conveying rollers 16*b* for conveying the fed recording paper sheet upward, registration rollers 19 for guiding the conveyed recording paper sheet between the secondary transfer roller 14 and the intermediate transfer belt 11 at a predetermined timing, and the paper discharge rollers 18*a* for discharging the recording paper sheet onto the catch tray 18.

Moreover, inside the image forming apparatus 100, the paper conveyance path P2 on which a pickup roller 17*a* and conveying rollers 16*b* are disposed is formed between the manual paper feeding tray 17 and the registration rollers 19. In addition, the paper conveyance path P3 is formed between the paper discharge rollers 18*a* and the upstream side of the registration rollers 19 in the paper conveyance path P1.

The paper discharge rollers 18*a* freely rotate in both forward and reverse directions, and are driven in the forward direction to discharge a recording paper sheet onto the catch tray 18 during single-sided image formation in which images are formed on one side of the recording paper sheets, and during second side image formation of double-sided image formation in which images are formed on both sides of the recording paper sheet. On the other hand, during first side image formation of double-sided image formation, the paper discharge rollers 18*a* are driven in the forward direction until a tail edge of the sheet passes through the fixing device 15, and are then driven in the reverse direction to bring the recording paper sheet into the paper conveyance path P3 in a state where the tail edge of the recording paper sheet is held. Thus, the recording paper sheet on which an image has been formed only on one side during double-sided image formation is brought into the paper conveyance path P1 in a state where the recording paper sheet is turned over and upside down.

The registration rollers 19 bring the recording paper sheet that has been fed from the paper feeding cassette 16 or the manual paper feeding tray 17, or has been conveyed through the paper conveyance path P3 between the secondary transfer roller 14 and the intermediate transfer belt 11 at a timing synchronized with the rotation of the intermediate transfer belt 11. Thus, the rotation of the registration rollers 19 is stopped when the operation of the photoreceptor drums 101 or the intermediate transfer belt 11 is started, and the movement of the recording paper sheet that has been fed or conveyed prior to the rotation of the intermediate transfer belt 11 is stopped in the paper conveyance path P1 in a state where a leading edge thereof abuts against the registration rollers 19. Then, the rotation of the registration rollers 19 is started at a timing when the leading edge of the recording paper sheet faces a leading edge of a toner image formed on the intermediate transfer belt 11 at a position where the secondary transfer roller 14 is brought into pressure-contact with the intermediate transfer belt 11.

Note that, during full-color image formation in which image formation is performed by all of the image forming sections Pa to Pd, all of the primary transfer rollers 13*a* to 13*d* bring the intermediate transfer belt 11 into pressure-contact with the photoreceptor drums 101*a* to 101*d*. On the other hand, during monochrome image formation in which image formation is performed only by the image forming section Pa, only the primary transfer roller 13*a* brings the intermediate transfer belt 11 into pressure-contact with the photoreceptor drum 101*a*.

Figure 2:
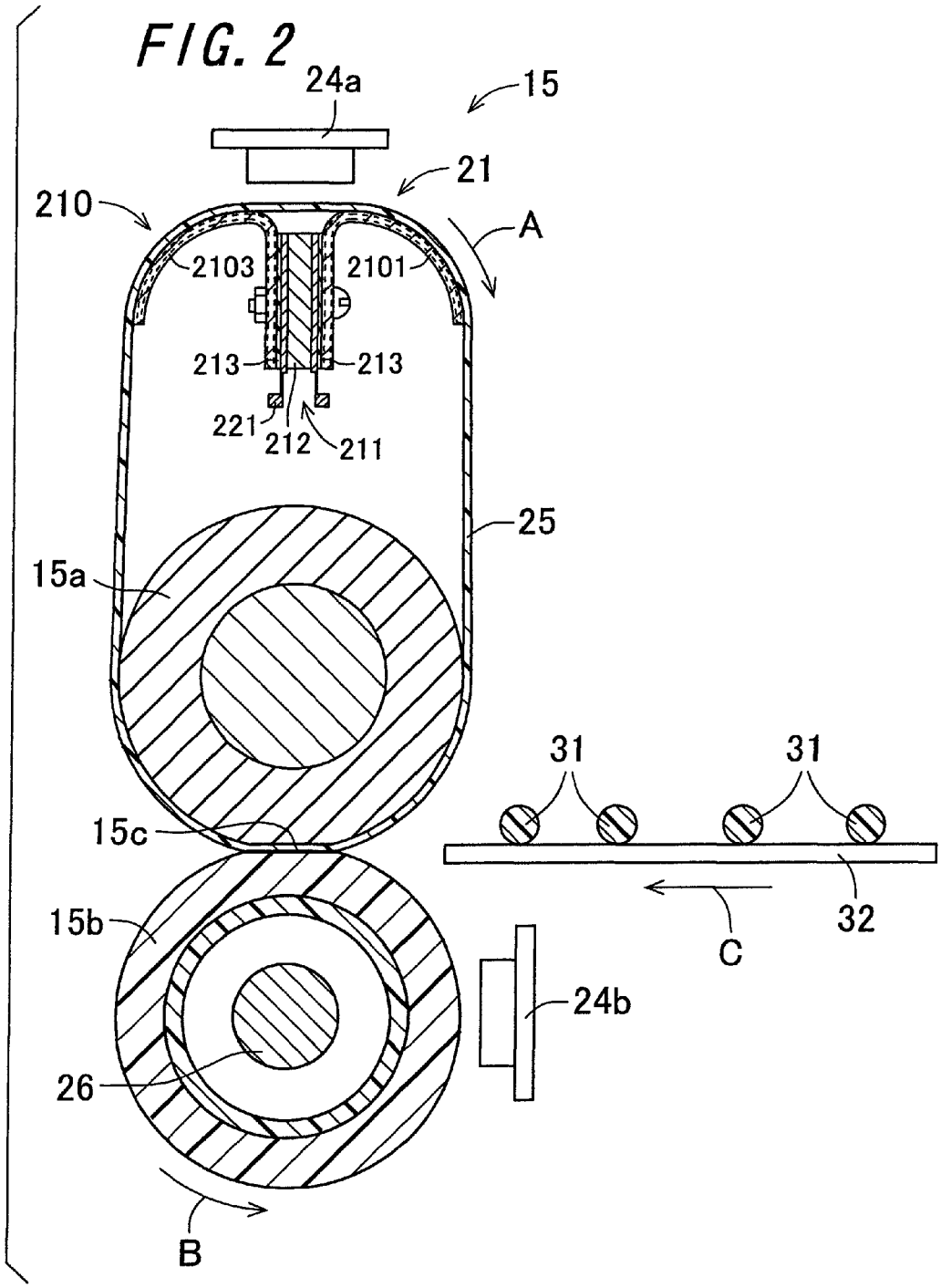
FIG. 2 is a view showing the structure of a fixing device according to a first embodiment of the invention.

FIG. 2 is a view showing the structure of the fixing device 15 according to a first embodiment of the invention. The fixing device 15 includes a fixing roller 15*a* serving as a first fixing member, a pressure roller 15*b* serving as a second fixing member, a fixing belt 25 serving as an endless-shaped belt, and a heating member 21. In the fixing device 15, the fixing belt 25 is supported around the fixing roller 15*a* and the heating member 21 with tension, and the pressure roller 15*b* is disposed so as to face the fixing roller 15*a*, with the fixing belt 25 interposed therebetween. Moreover, the fixing roller 15*a* and the heating member 21 are arranged substantially in parallel with each other in an axial direction of the fixing roller 15*a*. With this arrangement, the fixing belt 25 supported around the fixing roller 15*a* and the heating member 21 with tension can be prevented from running windingly during its sliding movement, wherefore the durability of the fixing belt 25 can be maintained at a high level.

The fixing device 15 is a fixing device of belt fixing type in which the heating member 21 comes into contact with the fixing belt 25 to heat the fixing belt 25, and when the recording paper sheet 32 serving as a recording medium passes through the fixing nip region 15*c* defined by the fixing belt 25 and the pressure roller 15*b* at a predetermined fixing speed and a copy speed, fixes the unfixed toner images 31 borne on the recording paper sheet 32 under application of heat and pressure. The fixing device 15 of belt fixing type is configured such that the fixing belt 25 having a small heat capacity is heated by the heating member 21 having the high-power-density heat generating layer 212. Therefore, a warm-up time is short, and an increase in power consumption is suppressed, thereby achieving power savings.

Note that the unfixed toner image 31 is formed of, for example, a developer (toner) such as a non-magnetic one-component type developer (non-magnetic toner), a non-magnetic two-component type developer (non-magnetic toner and carrier), or a magnetic developer (magnetic toner). Moreover, the "fixing speed" corresponds to a so-called process speed, and the "copying speed" corresponds to the number of copies obtained per minute. Further, when the recording paper sheet 32 passes through the fixing nip region 15*c*, the fixing belt 25 abuts against that surface of the recording paper sheet 32 which is opposite from the toner image-bearing surface thereof.

The fixing roller 15*a* is brought into pressure-contact with the pressure roller 15*b* with the fixing belt 25 interposed therebetween to thereby form the fixing nip region 15*c*, and at the same time, is rotated in a rotation direction A around a rotation axis by a not-shown driving motor (driving section) to thereby cause the fixing belt 25 to run. The fixing roller 15*a* has a diameter of 30 mm and has a two-layer structure consisting of a core metal and an elastic layer, which are arranged in this order from inside. For the core metal, for example, a metal such as iron, stainless steel, aluminum, and copper, an alloy thereof, or the like are used. Moreover, for the elastic layer, a heat resistant rubber material such as silicone rubber and fluorine rubber is suitable. Note that, in this embodiment, a force when the fixing roller 15*a* is brought into pressure-contact with the pressure roller 15*b* with the fixing belt 25 interposed therebetween is about 216 N.

The pressure roller 15*b* is provided to be opposite to and in pressure-contact with the fixing roller 15*a* with the fixing belt 25 interposed therebetween. The pressure roller 15*b* is freely rotatable around its rotation axis. The pressure roller 15*b* is rotated in a rotation direction B by rotation of the fixing roller 15*a*. The pressure roller 15*b* has a three-layered structure consisting of a core metal, an elastic layer, and a release layer, which are formed in this order from inside. For the core metal, for example, a metal such as iron, stainless steel, aluminum, or copper, or an alloy thereof is used. The elastic layer is preferably formed of a heat resistant rubber material such as silicone rubber or fluorine rubber. The release layer is preferably formed of fluorine resin such as PFA (a copolymer of tetrafluoroethylene and perfluoroalkyl vinyl ether) or PTFE (polytetrafluoroethylene). For the pressure roller 15*b*, for example, a roller may be used in which the diameter of the roller is 30 mm, an iron (STKM) pipe having a diameter of 24 mm (thickness 2 mm) is used for the core metal, solid silicone rubber having a thickness of 3 mm is used for the elastic layer, and a PFA tube having a thickness of 30 μm is used for the release layer.

The pressure roller 15*b* is provided with a heater lamp 26 (for example, rated power 400 W) for heating the pressure roller 15*b*, in an interior thereof. A control circuit (not shown) causes power to be supplied (energized) from a power supply circuit (not shown) to the heater lamp 26, the heater lamp 26 emits light, and infrared rays are radiated from the heater lamp 26. Thus, the inner circumferential surface of the pressure roller 15*b* absorbs the infrared rays and is heated, such that the entire pressure roller 15*b* is heated. Although the above-described heater lamp 26 heats the pressure roller 15*b* from the inner surface, the pressure roller 15*b* may be heated by a roller for outer circumference heating, from a surface thereof.

The fixing belt 25 is heated to a predetermined temperature by the heating member 21 and heats the recording paper sheet 32 having the unfixed toner image 31 formed thereon that passes through the fixing nip region 15*c*. The fixing belt 25 is an endless-shaped belt and is supported around the heating member 21 and the fixing roller 15*a* and wound up by the fixing roller 15*a* with a predetermined angle. During rotation of the fixing roller 15*a*, the fixing belt 25 is driven by the fixing roller 15*a* and rotates in the rotation direction A. The fixing belt 25 has a three-layer structure consisting of a substrate having a hollow cylindrical shape formed of a heat resistant resin such as polyimide or a metal material such as stainless steel and nickel, an elastic layer formed on the surface of substrate, formed of an elastomer material (for example, silicone rubber) having excellent heat resistance and elastic property, and a release layer formed on the surface of the elastic layer, formed of a synthetic resin material (for example, a fluorine resin such as PFA or PTFE) having excellent heat resistance and releasing property. Moreover, a fluorine resin may be added into polyimide constituting the substrate. This makes it possible to reduce a slide load with the heating member 21.

The heating member 21 is a member that comes into contact with the fixing belt 25 to heat the fixing belt 25 to a predetermined temperature. In the fixing device 15, a heat generating element-side thermistor 24*a* and a pressure roller-side thermistor 24*b* serving as a temperature detecting section are respectively provided on the circumferential surface of the fixing belt 25 in contact with the heating member 21 and on the circumferential surface of the pressure roller 15*b* to detect surface temperature.

Figure 3:
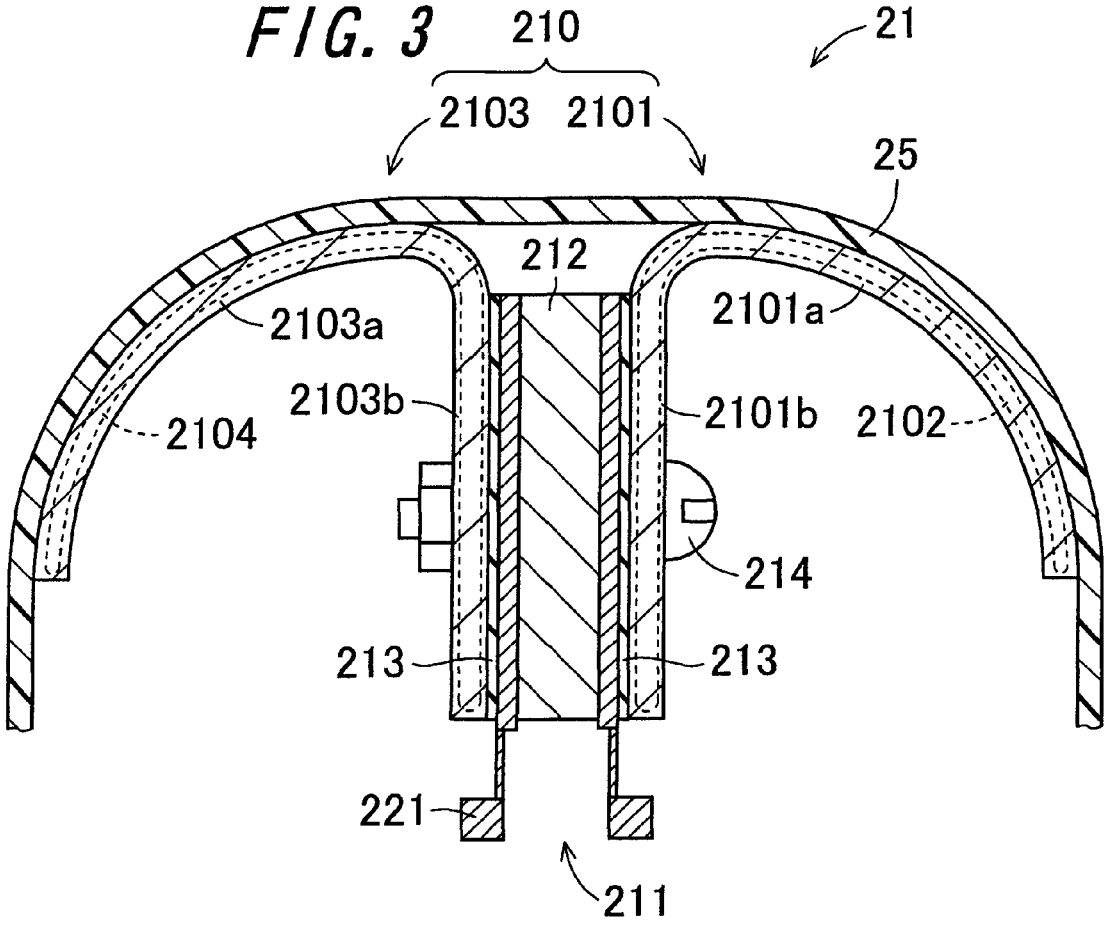
FIG. 3 is an enlarged view showing the configuration of a heating member.

FIG. 3 is an enlarged view showing the configuration of the heating member 21. The heating member 21 has a semicircular shape and includes a heat radiating member 210 and a heat generating member 211.

The heat radiating member 210 includes a heat receiving section that is provided to be in contact with a plurality of surfaces of a heat generating member 211 described below and receives heat generated by the heat generating member 211, and a heat transfer section that transfers heat received by the heat receiving section to the fixing belt 25. A heat transport section is provided inside the heat radiating member 210 to transport heat generated by the heat generating member 211 in the width direction and the circumferential direction of the fixing belt 25. In this embodiment, the heat radiating member 210 includes a first heat radiating section 2101 and a second heat radiating section 2103. The first heat radiating section 2101 and the second heat radiating section 2103 are formed of a metal material such as aluminum, copper, magnesium, iron, or titanium, an alloy material thereof, or a material having excellent thermal conductivity such as high-purity graphite.

The first heat radiating section 2101 includes a heat transfer piece 2101*a* and a heat receiving piece 2101*b*. The heat receiving piece 2101*b* is a portion that extends in the width direction of the fixing belt 25 (the axial direction of the fixing roller 15*a*) and has a vertically parallel surface extending from a central portion of a region where the heat radiating member 210 is in contact with the fixing belt 25, and that is provided to be in contact with one surface of the heat generating member 211 in the thickness direction thereof and receives heat generated by the heat generating member 211. The heat transfer piece 2101*a* is a portion that extends in the width direction of the fixing belt 25 from one end of the heat receiving piece 2101*b*, and that is provided to be curved along the inner circumferential surface of the fixing belt 25 and transfers heat received by the heat receiving piece 2101*b* to the fixing belt 25.

The second heat radiating section 2103 includes a heat transfer piece 2103*a* and a heat receiving piece 2103*b*. The heat receiving piece 2103*b* is a portion that extends in the width direction of the fixing belt 25 and has a vertically parallel surface extending from a central portion of a region where the heat radiating member 210 is in contact with the fixing belt 25, and that is provided to be in contact with the other surface of the heat generating member 211 in the thickness direction thereof and receives heat generated by the heat generating member 211. The heat transfer piece 2103*a* is a portion that extends in the width direction of the fixing belt 25 from one end of the heat receiving piece 2103*b*, and that is provided to be curved along the inner circumferential surface of the fixing belt 25 and transfers heat received by the heat receiving piece 2103*b* to the fixing belt 25.

In the heat radiating member 210 having the first heat radiating section 2101 and the second heat radiating section 2103 as described above, the heat receiving piece 2101*b* of the first heat radiating section 2101 and the heat receiving piece 2103*b* of the second heat radiating section 2103 are arranged to be opposite to each other. In the heat radiating member 210, the heat receiving piece 2101*b* of the first heat radiating section 2101 and the heat receiving piece 2103*b* of the second heat radiating section 2103 are combined with each other to form the heat receiving section that is in contact with both surfaces of the heat generating member 211 in the thickness direction thereof, which surfaces are two surfaces having a larger area in descending order from among the surfaces constituting the heat generating member 211, and that sandwiches the heat generating member 211. The heat transfer piece 2101*a* of the first heat radiating section 2101 and the heat transfer piece 2103*a* of the second heat radiating section 2103 are combined with each other to form the semi-circular cylindrical heat transfer section. Thus, the heat receiving section is formed to be in contact with two surfaces having a larger area in descending order. Therefore, the heat receiving efficiency by the heat receiving section, which receives heat generated by the heat generating member 211, can be increased, heat generation by the resistance heat generating element can be continuously and stably carried out, and the resistance heat generating element can be prevented from being in an overheated state and then damaged or burned out.

The heat transport section is provided inside the first heat radiating section 2101 and the second heat radiating section 2103 constituting the heat radiating member 210. The heat transport section transports heat, which is received from the heat generating member 211 by the heat receiving pieces 2101*b* and 2103*b* of the heat radiating sections 2101 and 2103, in the width direction and the circumferential direction of the fixing belt 25.

In this embodiment, the heat transport section that is provided inside the first heat radiating section 2101 includes a meandering capillary tube heat pipe (Heat Lane (Registered Trademark)) 2102 (hereinafter, simply referred to as "heat pipe 2102"), and is formed over the entire region inside the first heat radiating section 2101, that is, over the entire region inside the heat transfer piece 2101*a* and the heat receiving piece 2101*b*. The heat transport section that is provided inside the second heat radiating section 2103 includes a meandering capillary tube heat pipe 2104 (hereinafter, simply referred to as "heat pipe 2104"), and is formed over the entire region inside the second heat radiating section 2103, that is, over the entire region inside the heat transfer piece 2103*a* and the heat receiving piece 2103*b*.

The heat pipes 2102 and 2104 are configured such that a capillary tube filled with a heat transport fluid is repeatedly bent (meanders) so as to form a predetermined surface. The capillary tube has linear portions that extend linearly, and connection portions that connect ends of adjacent linear portions in the extension direction to form a single line. Examples of the heat transport fluid include water, butane, alcohol, inert gas, and the like.

The heat pipes 2102 and 2104 are configured such that the heat transport fluid filled in the capillary tube is evaporated at a high-temperature portion and condensed at a low-temperature portion, thereby transporting heat. With the heat pipes 2102 and 2104, the heat transport fluid is repeatedly evaporated and condensed in the capillary tube arranged in a meandering manner, such that a large amount of heat can be transported within a short time, as compared with heat transport only by thermal conduction by a metal material or the like. That is, while in the case of heat transport only by thermal conduction, heat passively moves on the basis of a difference in temperature, with the heat pipes 2102 and 2104, active heat transport by evaporation and condensation of the heat transport fluid is carried out. Therefore, a large amount of heat is absorbed and radiated by the heat transport fluid, such that a large amount of heat can be transported by repeated evaporation and condensation.

In the fixing device 15 that includes the heating member 21 having the heat radiating member 210 thus configured, heat received by the heat receiving piece 2101*b* in contact with one surface of the heat generating member 211 in the thickness direction thereof and the heat receiving piece 2103*b* in contact with the other surface of the heat generating member 211 in the thickness direction thereof moves along the first heat radiating section 2101 and the second heat radiating section 2103 by thermal conduction, and, simultaneously, is transported in the width direction and the circumferential direction of the fixing belt 25 by the heat pipes 2102 and 2104, and is transferred from the heat transfer piece 2101*a* and the heat transfer piece 2103*a* to the fixing belt 25, thereby heating the fixing belt 25. For this reason, a uniform temperature distribution in the width direction and the circumferential direction of the fixing belt 25 is achieved, and thus a high-quality fixed image can be obtained.

The heat pipes 2102 and 2104 having high heat transport capability are provided inside the heat radiating member 210. Therefore, even when a high-power-density heat generating element is used as the resistance heat generating element constituting the heat generating member 211, heat generated by the resistance heat generating element can be rapidly transported, and the heat radiating member 210 can be increased in temperature within a short time.

In the heat radiating member 210, the heat receiving piece 2101*b* is provided to be in contact with one surface of the heat generating member 211 in the thickness direction thereof and receives heat generated by the heat generating member 211, and the heat receiving piece 2103*b* is provided to be in contact with the other surface of the heat generating member 211 in the thickness direction thereof and receives heat generated by the heat generating member 211. Therefore, heat receiving efficiency can be increased, and the resistance heat generating element constituting the heat generating member 211 can be prevented from being in the overheated state. For this reason, self-suppression of energization can be prevented from occurring in the resistance heat generating element. As a result, heat generation by the resistance heat generating element can be continuously and stably carried out, heat generation efficiency can be prevented from being deteriorated, and the warm-up time can be reduced.

The heat transport sections provided inside the first heat radiating section 2101 and the second heat radiating section 2103 may be configured by a combination of a plurality of meandering capillary tube heat pipes.

Figure 4A:
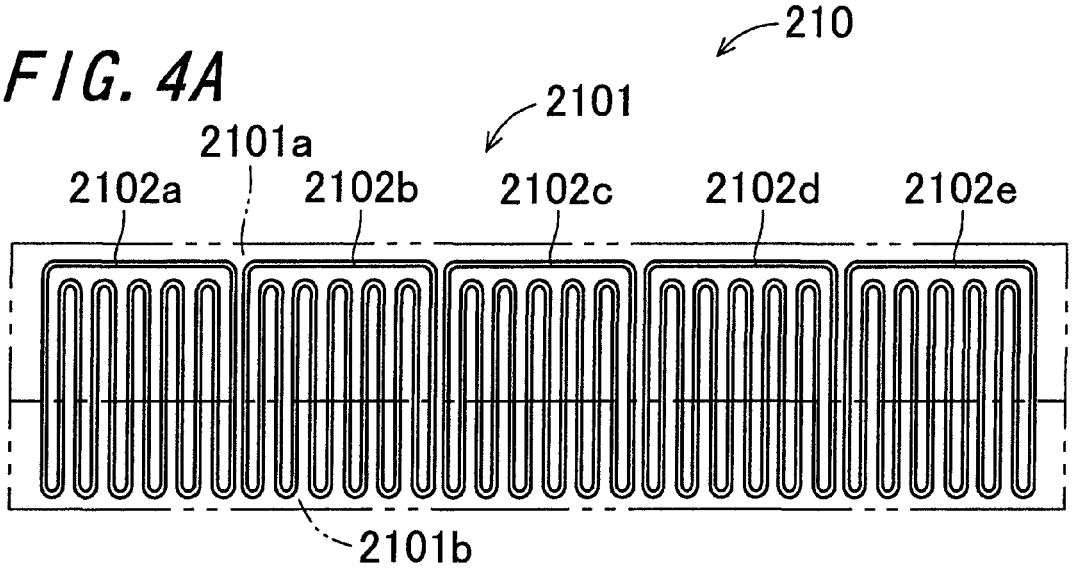
FIGS. 4A and 4B are views showing the configuration of heat pipes provided inside the heat radiating member.
Figure 4B:
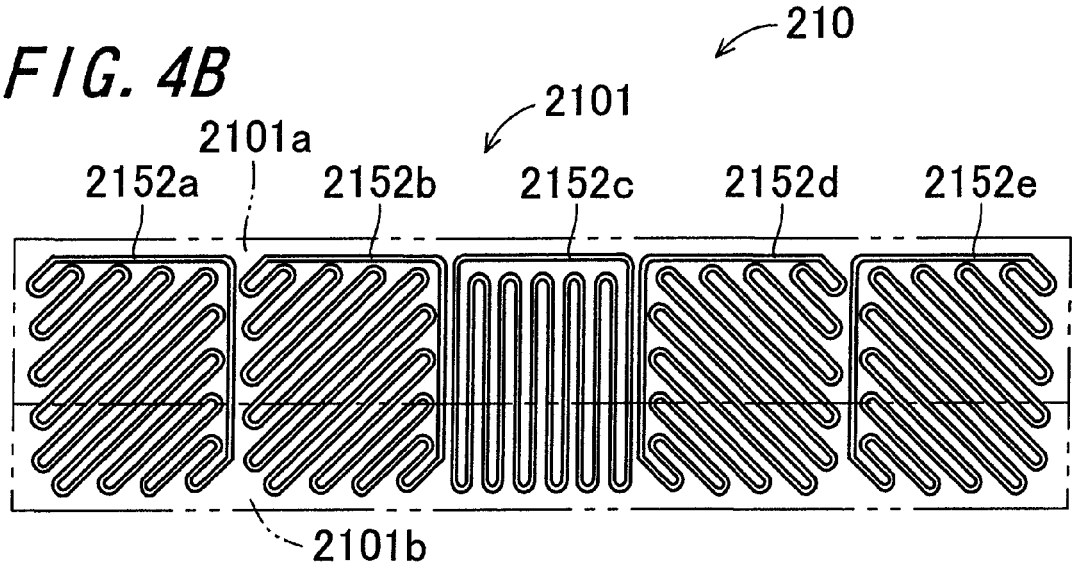

FIGS. 4A and 4B are views showing the configuration of heat pipes provided inside the heat radiating member 210. FIGS. 4A and 4B show the configuration of a plurality of heat pipes 2102 provided inside the first heat radiating section 2101. The configuration of a plurality of heat pipes 2104 provided inside the second heat radiating section 2103 is the same as the configuration of the heat pipes 2102 of the first heat radiating section 2101. Hereinafter, description will be provided for the configuration of a plurality of heat pipes 2102 provided inside the first heat radiating section 2101.

As described above, the heat pipes 2102 are configured such that a capillary tube filled with a heat transport fluid is repeatedly bent (meanders) so as to form a predetermined surface. The capillary tube includes linear portions that extend linearly, and connection portions that connect the ends of adjacent linear portions in the extension direction to form a single line. Adjustment of the extension direction of the linear portions ensures control of the heat transport efficiency of the heat pipes 2102 in the width direction and the circumferential direction of the fixing belt 25. For example, in the case of the first heat radiating section 2101 having the heat pipes 2102, in which the extension direction of the linear portions is in parallel to the width direction of the fixing belt 25, the heat transport efficiency in the width direction of the fixing belt 25 is particularly improved. In the case of the first heat radiating section 2101 having the heat pipes 2102, in which the extension direction of the linear portions is orthogonal to the width direction of the fixing belt 25, the heat transport efficiency in the circumferential direction of the fixing belt 25 is particularly improved. In the case of the first heat radiating section 2101 having the heat pipes 2102, in which the extension direction of the linear portions is inclined at a predetermined angle in the width direction of the fixing belt 25, the heat transport efficiency in the width direction and the circumferential direction of the fixing belt 25 is improved.

The heat transport section, shown in FIG. 4A, provided inside the first heat radiating section 2101 is configured by a combination of a plurality of heat pipes 2102*a*, 2102*b*, 2102*c*, 2102*d*, and 2102*e*, and is formed over the entire region inside the first heat radiating section 2101, that is, over the entire region inside the heat transfer piece 2101*a* and the heat receiving piece 2101*b*.

The respective heat pipes 2102*a*, 2102*b*, 2102*c*, 2102*d*, and 2102*e* are meandering capillary tube heat pipes in which the extension direction of the linear portions is orthogonal to the width direction of the fixing belt 25. The respective heat pipes are arranged in the longitudinal direction of the first heat radiating section 2101 (the width direction of the fixing belt 25) at a predetermined interval. The interval between the respective heat pipes 2102*a*, 2102*b*, 2102*c*, 2102*d*, and 2102*e* is set so as to ensure heat movement by thermal conduction between the respective heat pipes.

In the first heat radiating section 2101 having the heat pipes 2102*a*, 2102*b*, 2102*c*, 2102*d*, and 2102*e*, heat received by the heat receiving piece 2101*b* provided to be in contact with one surface of the heat generating member 211 in the thickness direction thereof moves along the first heat radiating section 2101 by thermal conduction, and is further transported in the width direction and the circumferential direction of the fixing belt 25 by the heat pipes 2102*a*, 2102*b*, 2102*c*, 2102*d*, and 2102*e*, and transferred from the heat transfer piece 2101*a* to the fixing belt 25, thereby heating the fixing belt 25. For this reason, a uniform temperature distribution in the width direction and the circumferential direction of the fixing belt 25 is achieved, and thus a high-quality fixed image can be obtained. The heat transport section that is provided inside the first heat radiating section 2101 is configured by a combination of the plurality of meandering capillary tube heat pipes, such that the first heat radiating section 2101 having a larger area can be rapidly and uniformly heated.

As shown in FIG. 4B, a plurality of heat pipes that are different in the extension direction of the linear portions may be combined with each other and used as the heat transport section. The heat transport section, shown in FIG. 4B, provided inside the first heat radiating section 2101 is configured by a combination of a plurality of heat pipes 2152*a*, 2152*b*, 2152*c*, 2152*d*, and 2152*e*, and is formed over the entire region inside the first heat radiating section 2101, that is, over the entire region inside the heat transfer piece 2101*a* and the heat receiving piece 2101*b*.

The respective heat pipes 2152*a*, 2152*b*, 2152*d*, and 2152*e* that are arranged at both ends of the first heat radiating section 2101 in the longitudinal direction thereof corresponding to both ends of the fixing belt 25 in the width direction thereof are meandering capillary tube heat pipes in which the extension direction of the linear portions is inclined at a predetermined angle in the width direction of the fixing belt 25. The heat pipe 2152*c* that is arranged at the central portion of the first heat radiating section 2101 in the longitudinal direction thereof corresponding to the central portion of the fixing belt 25 in the width direction thereof is a meandering capillary tube heat pipe in which the extension direction of the linear portions is orthogonal to the width direction of the fixing belt 25. The respective heat pipes 2152*a*, 2152*b*, 2152*c*, 2152*d*, and 2152*e* are arranged in the longitudinal direction of the first heat radiating section 2101 (the width direction of the fixing belt 25) at a predetermined interval. The interval between the respective heat pipes 2152*a*, 2152*b*, 2152*c*, 2152*d*, and 2152*e* is set so as to ensure heat movement by thermal conduction between the respective heat pipes.

When the recording paper sheets 32 of a small-width size pass successively through the fixing nip region 15*c*, both ends of the fixing belt 25 in the width direction thereof (the paper non-passing region) is likely to be heated. In contrast, the respective heat pipes 2152*a*, 2152*b*, 2152*d*, and 2152*e* that are arranged at both ends of the first heat radiating section 2101 in the longitudinal direction thereof corresponding to both ends of the fixing belt 25 in the width direction thereof are meandering capillary tube heat pipes in which the extension direction of the linear portions are inclined at a predetermined angle in the width direction of the fixing belt 25. Therefore, heat can be rapidly transported in the width direction and the circumferential direction of the fixing belt 25, and a uniform temperature distribution in the width direction and the circumferential direction of the fixing belt 25 can be achieved. That is, in a case where the resistance heat generating element of the heat generating member 211 corresponding to the paper non-passing region of the fixing belt 25 is not energized, when the thermal balance of the paper non-passing region is positive, although temperature may rise and the temperature distribution of the fixing belt 25 may become uneven, heat transport from a high-temperature portion to a low-temperature portion may be carried out by the heat transport capability of the heat pipes 2152*a*, 2152*b*, 2152*d*, and 2152*e* arranged at both ends of the first heat radiating section 2101 in the longitudinal direction thereof, such that the temperature distribution of the fixing belt 25 may become even.

At the time of a fixing operation of the fixing device 15, the central portion of the fixing belt 25 in the width direction thereof has a small change in temperature, but a large amount of heat is required since the recording paper sheet 32 passes therethrough. In contrast, the heat pipe 2152*c* arranged at the central portion of the first heat radiating section 2101 in the longitudinal direction thereof corresponding to the central portion of the fixing belt 25 in the width direction thereof is a meandering capillary tube heat pipe in which the extension direction of the linear portions is orthogonal to the width direction of the fixing belt 25. The heat pipe 2152*c* particularly has excellent heat transport efficiency in the circumferential direction of the fixing belt 25. Therefore, high temperature followability of the first heat radiating section 2101 with respect to the central portion of the fixing belt 25 in the width direction thereof where a large amount of heat is required can be maintained.

Next, the heat generating member 211 provided in the heating member 21 will be described with reference to FIGS. 2 and 3 again. The heat generating member 211 is a rectangular plate-shaped member that extends in the longitudinal direction of the heat radiating member 210 (the width direction of the fixing belt 25). The heat generating member 211 is fastened by a fastening member 214 such as a screw member, in a state of being sandwiched between the heat receiving piece 2101*b* of the first heat radiating section 2101 and the heat receiving piece 2103*b* of the second heat radiating section 2103.

The heat generating member 211 has a laminated structure in which insulator layers 213 composed of an insulator are formed on both surfaces in the thickness direction of the heat generating layer 212 including the resistance heat generating element that generates heat due to being energized. In the heat generating member 211, the insulator layer 213 that is formed on one surface of the heat generating layer 212 in the thickness direction thereof is provided to be in surface-contact with the heat receiving piece 2101*b* of the first heat radiating section 2101. The insulator layer 213 that is formed on the other surface of the heat generating layer 212 in the thickness direction thereof is provided to be in surface-contact with the heat receiving piece 2103*b* of the second heat radiating section 2103. That is, the heat generating member 211 is configured such that both surfaces in the thickness direction thereof, which are two surfaces having a larger area in descending order, are in surface-contact with the heat receiving piece 2101*b* and the heat receiving piece 2103*b* constituting the heat receiving sections of the heat radiating member 210.

The insulator layers 213 are formed of a material having heat resistance and electrical insulation. The material having heat resistance and electrical insulation is not particularly limited, and a heat-resistance polymer material such as polyimide resin, a ceramic material such as alumina, or mica may be used.

The heat generating layer 212 is a layer composed of a resistance heat generating element that generates heat by using Joule heat occurring when energization is provided by applying a voltage to power supply terminals 221. The resistance heat generating element constituting the heat generating layer 212 may be formed of a metal material mainly containing nickel-chromium alloy, a metal resistor having an electrically resistive component formed of stainless steel, or a resistant material such as silver-palladium. As a resistance heat generating element, a ceramic heat generating element in which a resistance wire having a width of about 1 mm is formed on a ceramic substrate having a width of 12 mm by screen printing, a ceramic heat generating element in which a plurality of thin-film ceramic sheets are laminated and a fine resistance wire is formed between the sheets and fired, or a ceramic heat generating element in which an inorganic material mainly containing barium titanate-based semiconductor ceramic is fired may be used. The ceramic heat generating element is a heat generating element that can realize high power density. Thus, the heat generating member 211 that has the heat generating layer 212 including a ceramic heat generating element has a high thermoresponsive rate, thereby reducing the warm-up time, and has high heating capability with respect to the heat radiating member 210.

The resistance heat generating element preferably has a positive resistance-temperature property (Positive Temperature Coefficient; PTC property). In the case of a resistance heat generating element having a positive resistance-temperature property, as temperature rises, electrical resistance increases. When a resistance heat generating element having a positive resistance-temperature property is heated to be equal to or higher than a predetermined temperature, electrical resistance rapidly increases and the amount of current decreases, such that the resistance heat generating element is prevented from being in an overheated state. In the case of a resistance heat generating element having a positive resistance-temperature property, as temperature rises, the amount of current decreases, such that power consumption can be reduced and power savings can be realized. The heat generating member 211 including the resistance heat generating element is configured such that a plurality of surfaces from among the surfaces constituting the heat generating member 211 are provided to be in contact with the heat receiving sections of the heat radiating member 210 having the heat transport sections. Therefore, even when the resistance heat generating element is a heat generating element having a positive resistance-temperature property, a uniform temperature distribution on the surface of the heat transfer section of the heat radiating member 210 is achieved, and a uniform temperature distribution in the width direction and the circumferential direction of the fixing belt 25 is achieved. In addition, heat generation by the resistance heat generating element is stably carried out, and thus heat generation efficiency is prevented from being deteriorated.

The resistance heat generating element may have a negative resistance-temperature property (Negative Temperature Coefficient; NTC property). In the case of a resistance heat generating element having a negative resistance-temperature property, as temperature rises, electrical resistance decreases. The heat generating member 211 including the resistance heat generating element is configured such that a plurality of surfaces from among the surfaces constituting the heat generating member 211 are provided to be in contact with the heat receiving sections of the heat radiating member 210 having the heat transport sections. Therefore, even when the resistance heat generating element is a heat generating element having a negative resistance-temperature property, a uniform temperature distribution on the surface of the heat transfer section of the heat radiating member 210 is achieved, and a uniform temperature distribution in the width direction and the circumferential direction of the fixing belt 25 is achieved. In addition, heat generation by the resistance heat generating element is stably carried out, and thus heat generation efficiency is prevented from being deteriorated.

The resistance heat generating element may have a positive resistance-temperature property and a negative resistance-temperature property. The heat generating member 211 including the resistance heat generating element is configured such that a plurality of surfaces from among the surfaces constituting the heat generating member 211 are provided to be in contact with the heat receiving section of the heat radiating member 210 having the heat transport section. Therefore, even when the resistance heat generating element is a heat generating element having a positive resistance-temperature property and a negative resistance-temperature property, a uniform temperature distribution on the surface of the heat transfer section of the heat radiating member 210 is achieved, and a uniform temperature distribution in the width direction and the circumferential direction of the fixing belt 25 is achieved. In addition, heat generation by the resistance heat generating element is stably carried out, such that heat generation efficiency is prevented from being deteriorated. The resistance heat generating element having a positive resistance-temperature property and a negative resistance-temperature property refers to a heat generating element that has a negative resistance-temperature property at normal temperature, has a positive resistance-temperature property at predetermined temperature, and as temperature further rises, has a large rate of change in electrical resistance while having a positive resistance-temperature property (also referred to as a PTC ceramic heater).

Figure 5:
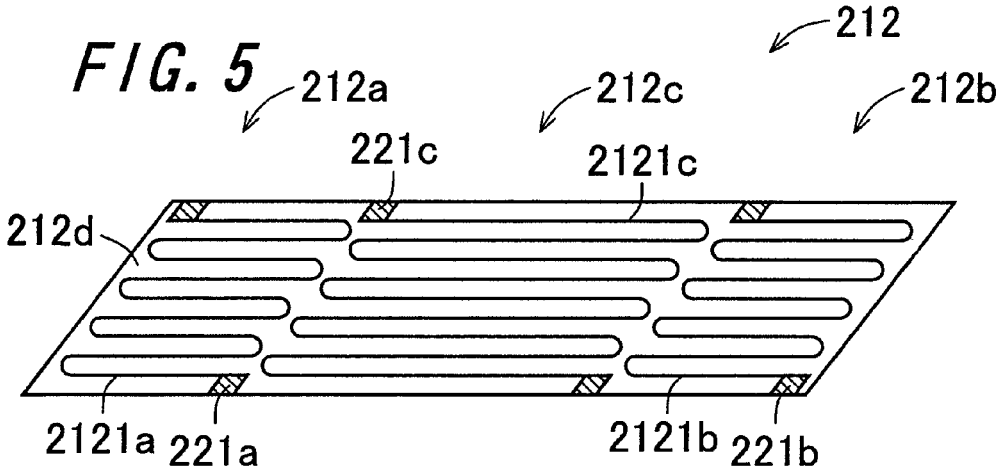
FIG. 5 is a view showing the configuration of a heat generating layer of a heat generating member provided in the heating member.

FIG. 5 is a view showing the configuration of the heat generating layer 212 of the heat generating member 211 provided in the heating member 21. The heat generating layer 212 is configured such that a heat generating portion where heat is generated due to energization is divided into a first heat generating region 212*a*, a second heat generating region 212*b*, and a third heat generating region 212*c* along the longitudinal direction of the heat radiating member 210. In this embodiment, on the assumption that printing is performed on recording paper sheets 32 of different sizes, the surface of each of the heat transfer sections of the heat radiating member 210, which heats the fixing belt 25 in contact with the recording paper sheets 32, is divided into three regions which are both end portions and a central portion in the longitudinal direction thereof. The first heat generating region 212*a* and the second heat generating region 212*b* of the heat generating layer 211 correspond to both end portions of the heat radiating member 210 in the longitudinal direction thereof, and the third heat generating region 212*c* corresponds to the central portion of the heat radiating member 210 in the longitudinal direction thereof.

Inside the first heat generating region 212*a*, a single resistance heat generating element 2121*a*, which is repeatedly bent so as to form a predetermined surface as a whole, is provided on a ceramic sheet 212*d*. Both ends of the resistance heat generating element 2121*a* are connected to a pair of power supply terminals 221*a*. Inside the second heat generating region 212*b*, a single resistance heat generating element 2121*b*, which is repeatedly bent so as to form a predetermined surface as a whole, is provided on the ceramic sheet 212*d*. Both ends of the resistance heat generating element 2121*b* are connected to a pair of power supply terminals 221*b*. Inside the third heat generating region 212*c*, a single resistance heat generating element 2121*c*, which is repeatedly bent so as to form a predetermined surface as a whole, is provided on the ceramic sheet 212*d*. Both ends of the resistance heat generating element 2121*c* are connected to a pair of power supply terminals 221*c*.

That is, the resistance heat generating element 2121*a* inside the first heat generating region 212*a*, the resistance heat generating element 2121*b* inside the second heat generating region 212*b*, and the resistance heat generating element 2121*c* inside the third heat generating region 212*c* are connected to different power supply terminals 221*a*, 221*b*, and 221*c*, and the heat generating regions can be energized separately. Thus, when printing is performed on the recording paper sheets 32 of different sizes, on/off of energization is switched for the respective heat generating regions 212*a*, 212*b*, and 212*c* such that a desired temperature distribution on the surface of the heat generating layer 212 is obtained in accordance with the recording paper sheets of different sizes. Therefore, sub-heating control can be performed such that only a desired specific region on the surface of the heat generating layer 212 generates heat. As a result, abnormal local heating of the resistance heat generating elements inside the heat generating regions corresponding to both end portions of the recording paper sheet 32 in the width direction thereof can be suppressed.

As described above, the respective resistance heat generating elements 2121*a*, 2121*b*, and 2121*c* constituting the heat generating layer 212 are configured so as to form a predetermined surface as a whole. Thus, heat transfer efficiency when heat of the resistance heat generating elements 2121*a*, 2121*b*, and 2121*c* due to energization is transferred to the heat radiating member 210 can be improved.

Figure 6:
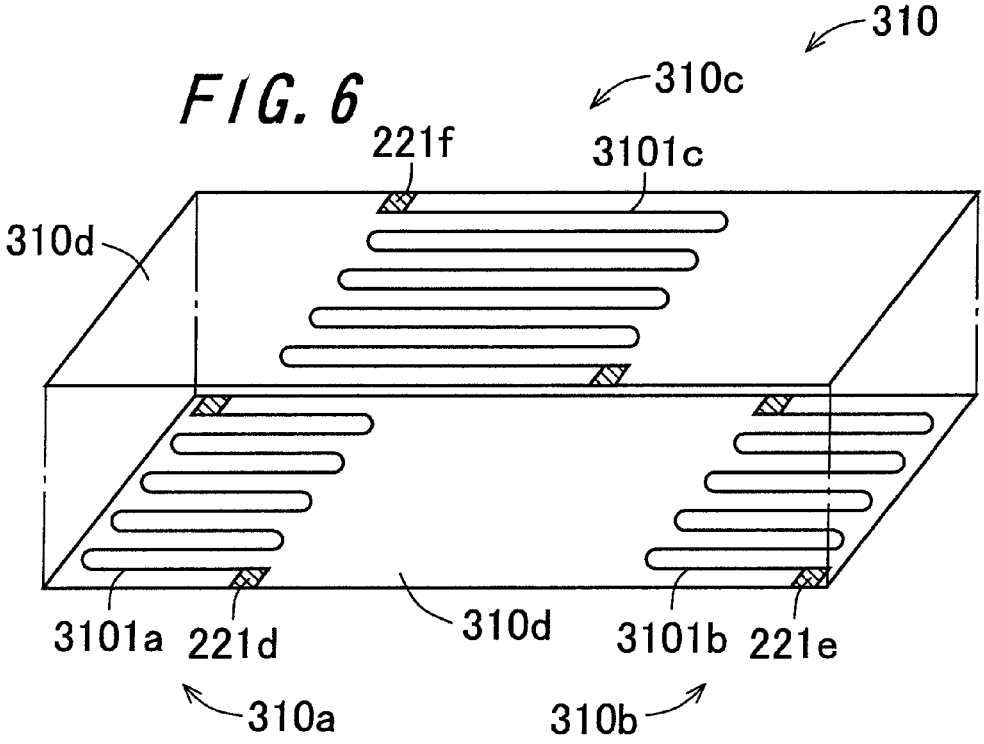
FIG. 6 is a view showing the configuration of a heat generating layer having a laminated structure in which a plurality of resistance heat generating elements are laminated.

The heat generating layer of the heat generating member 211 may have a laminated structure in which a plurality of resistance heat generating elements are laminated. FIG. 6 is a view showing the configuration of a heat generating layer 310 having a laminated structure, in which a plurality of resistance heat generating elements are laminated.

The heat generating layer 310 shown in FIG. 6 is formed by laminating a plurality of ceramic sheets having a width of 12 mm corresponding to the circumferential direction of the heat radiating member 210, providing a silver-palladium-based thin-film resistance heat generating element having a line width of 1 mm on the matching surface of each ceramic sheet so as to reciprocate and turn back 2.5 times by screen printing, and firing the thin-film resistance heat generating element. The size of the respective ceramic sheets, and the material, width, thickness, and the turnback pattern at the time of printing of the thin-film resistance heat generating element are appropriately set in accordance with the necessary heat generation capability of the heat generating layer 310. The heat generating layer 310 including a ceramic heat generating element laminated with ceramic sheets can be rapidly heated, and even when the heat generating layer 310 itself is in the overheated state, safety is ensured since smoking generation or ignition does not occur while damages occur.

The heat generating layer 310 is divided into a first heat generating region 310*a*, a second heat generating region 310*b*, and a third heat generating region 310*c* corresponding to the longitudinal direction of the heat radiating member 210. In this embodiment, on the assumption that printing is performed on the recording paper sheets 32 of different sizes, the surface of each of the heat transfer sections of the heat radiating member 210, which heats the fixing belt 25 in contact with the recording paper sheets 32, is divided into three regions which are both end portions and a central portion in the longitudinal direction thereof. The first heat generating region 310*a* and the second heat generating region 310*b* of the heat generating layer 310 correspond to both end portions of the heat radiating member 210 in the longitudinal direction thereof, and the third heat generating region 310*c* corresponds to the central portion of the heat radiating member 210 in the longitudinal direction thereof.

The heat generating layer 310 has a laminated structured in which the first heat generating region 310*a* and the second heat generating region 310*b* are formed on the same ceramic sheet 310*d*, and the third heat generating region 310*c* is formed on a different ceramic sheet 310*d*. A single resistance heat generating element 3101*a*, which is repeatedly bent so as to form a predetermined surface as a whole, is provided inside the first heat generating region 310*a*. Both ends of the resistance heat generating element 3101*a* are connected to a pair of power supply terminals 221*d*. A single resistance heat generating element 3101*b*, which is repeatedly bent so as to form a predetermined surface as a whole, is provided inside the second heat generating region 310*b*. Both ends of the resistance heat generating element 3101*b* are connected to a pair of power supply terminals 221*e*. A single resistance heat generating element 3101*c*, which is repeatedly bent so as to form a predetermined surface as a whole, is provided inside the third heat generating region 310*c*. Both ends of the resistance heat generating element 3101*c* are connected to a pair of power supply terminals 221*f*.

That is, the resistance heat generating element 3101*a* inside the first heat generating region 310*a*, the resistance heat generating element 3101*b* inside the second heat generating region 310*b*, and the resistance heat generating element 3101*c* inside the third heat generating region 310*c* are connected to different power supply terminals 221*d*, 221*e*, and 221*f*, and the heat generating regions can be energized separately. Thus, when printing is performed on the recording paper sheets 32 of different sizes, on/off of energization is switched for the respective heat generating regions 310*a*,

310*b*, and 310*c* such that a desired temperature distribution on the surface of the heat generating layer 310 is obtained in accordance with the recording paper sheets of different sizes. Therefore, sub-heating control can be performed such that only a desired specific region on the surface of the heat generating layer 310 generates heat. As a result, abnormal local heating of the resistance heat generating elements inside the heat generating regions corresponding to both end portions of the recording paper sheet 32 in the width direction thereof can be suppressed.

The heating member provided in the fixing device 15 is not limited to the configuration of the above-described heating member 21, and heating members shown in FIGS. 7A to 7C, 8A, 8B, and 9 to 12 may be used.

Figure 7A:
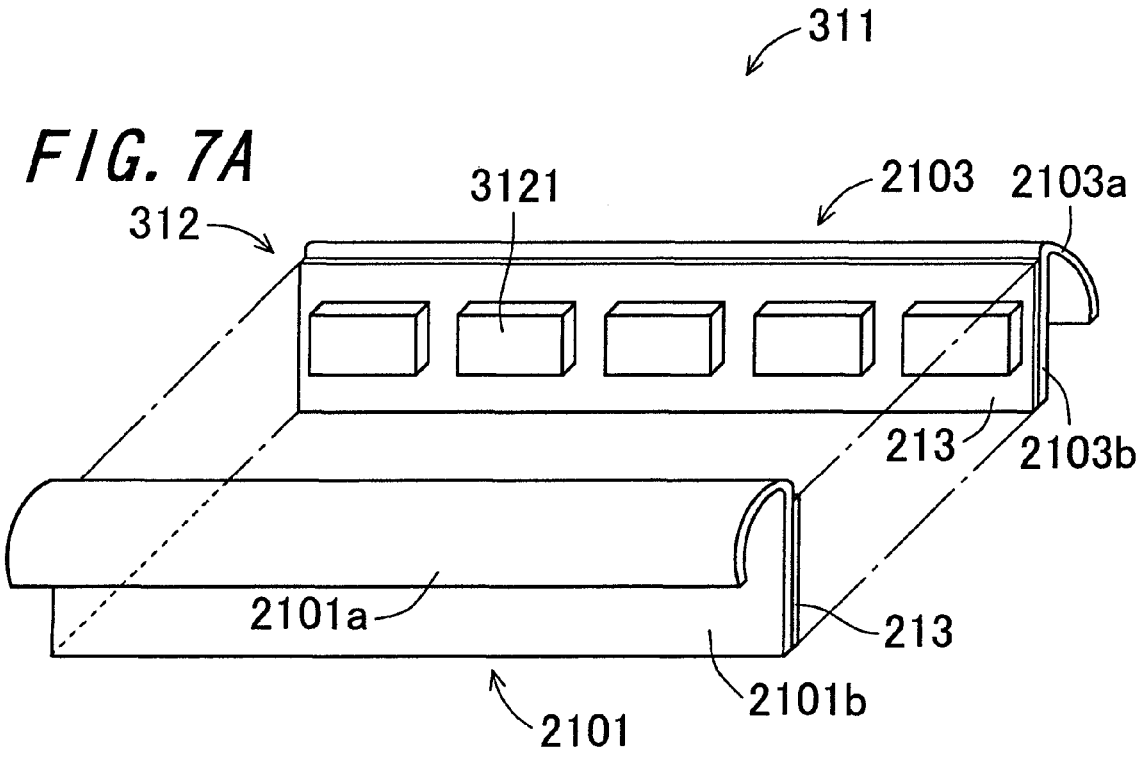
FIGS. 7A to 7C are views showing the configuration of a heating member which is another example of the heating member.
Figure 7B:
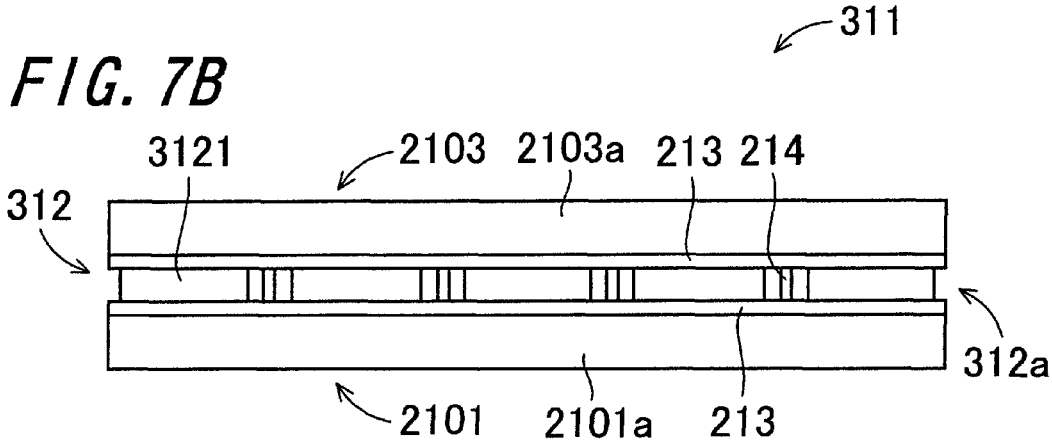
Figure 7C:
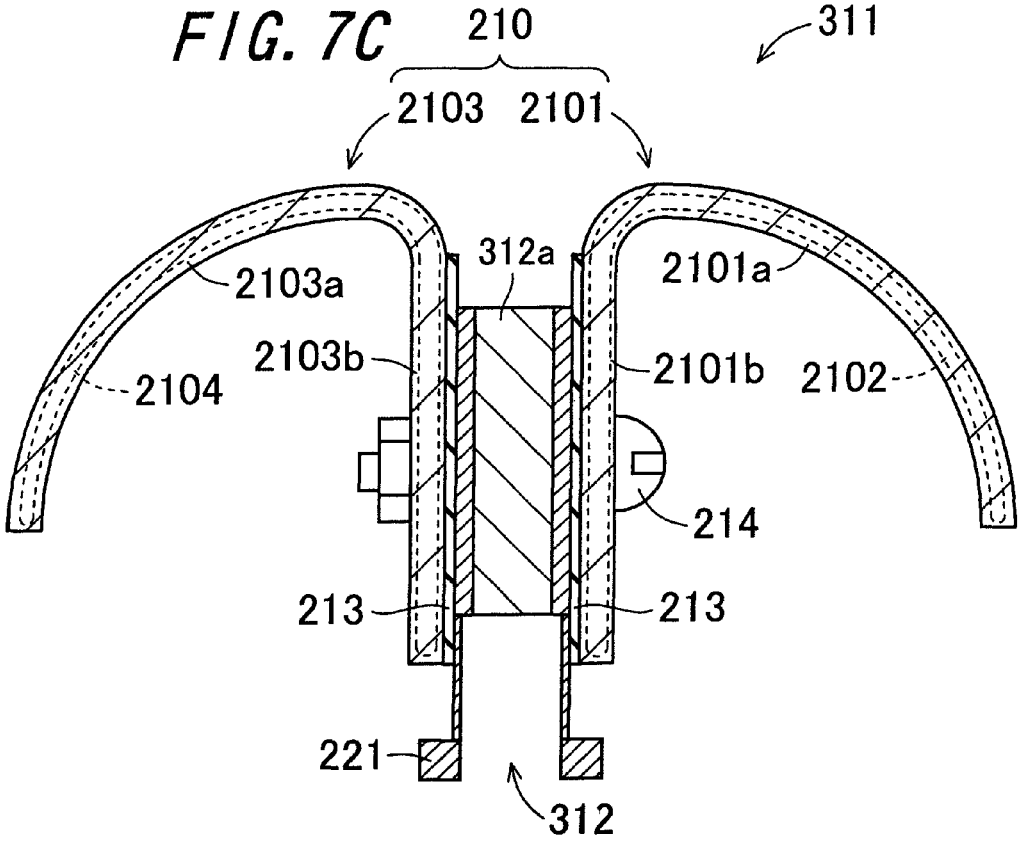

FIGS. 7A to 7C are views showing the configuration of a heating member 311 which is another example of the heating member. FIG. 7A is a perspective view of the heating member 311. FIG. 7B is a plan view of the heating member 311. FIG. 7C is a sectional view taken along the plane orthogonal to the width direction of the heating member 311.

The heating member 311 is similar to the above-described heating member 21, and includes a heat radiating member 210, which is the same as the heat radiating member provided in the heating member 21, and a heat generating member 312. The heat generating member 312 is a rectangular plate-shaped member that extends in the longitudinal direction of the heat radiating member 210 (the width direction of the fixing belt 25). The heat generating member 312 is fastened by a fastening member 214 such as a screw member, in a state of being sandwiched between the heat receiving piece 2101*b* of the first heat radiating section 2101 and the heat receiving piece 2103*b* of the second heat radiating section 2103.

The heat generating member 312 has a laminated structure in which insulator layers 213 formed of an insulator are formed on both surfaces in the thickness direction of a heat generating layer 312*a* including a resistance heat generating element that generates heat due to being energized. In the heat generating member 312, the insulator layer 213 that is formed on one surface of the heat generating layer 312*a* in the thickness direction thereof is provided to be in surface-contact with the heat receiving piece 2101*b* of the first heat radiating section 2101, and the insulator layer 213 that is formed on the other surface of the heat generating layer 312*a* in the thickness direction thereof is provided to be in surface-contact with the heat receiving piece 2103*b* of the second heat radiating section 2103. That is, the heat generating member 312 is configured such that both surfaces in the thickness direction thereof, which are two surfaces having a larger area in descending order, are in surface-contact with the heat receiving piece 2101*b* and the heat receiving piece 2103*b* constituting the heat receiving sections of the heat radiating member 210.

The heat generating layer 312*a* is a layer composed of a resistance heat generating element that generates heat by using Joule heat occurring when energization is provided by applying a voltage to the power supply terminals 221. The heat generating layer 312*a* is configured such that a plurality of semiconductor ceramic elements 3121, which are rectangular plate-shaped resistance heat generating elements, are arranged at an interval in the longitudinal direction of the heat radiating member 210 corresponding to the width direction of the fixing belt 25. Therefore, the heat generating layer 312*a* having a heat generating surface in a predetermined shape as a whole can be formed with simple configuration.

The semiconductor ceramic elements 3121 are formed by molding inorganic powder mainly containing barium titanate in a rectangular plate shape and firing the molded product. Each semiconductor ceramic element 3121 is configured such that the amount of heat generation of tens of watts (W) to hundreds of watts (W) is obtained.

Figure 8A:
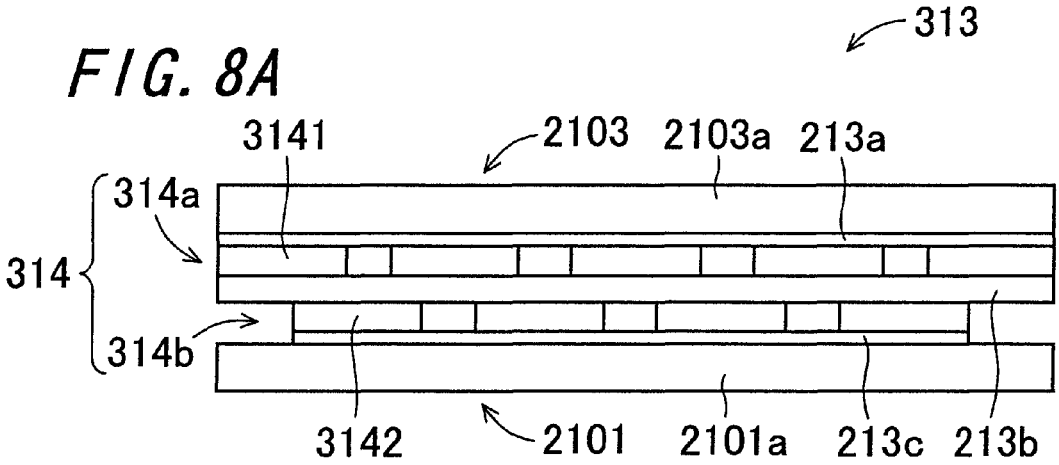
FIGS. 8A and 8B are views showing the configuration of a heating member which is another example of the heating member.
Figure 8B:
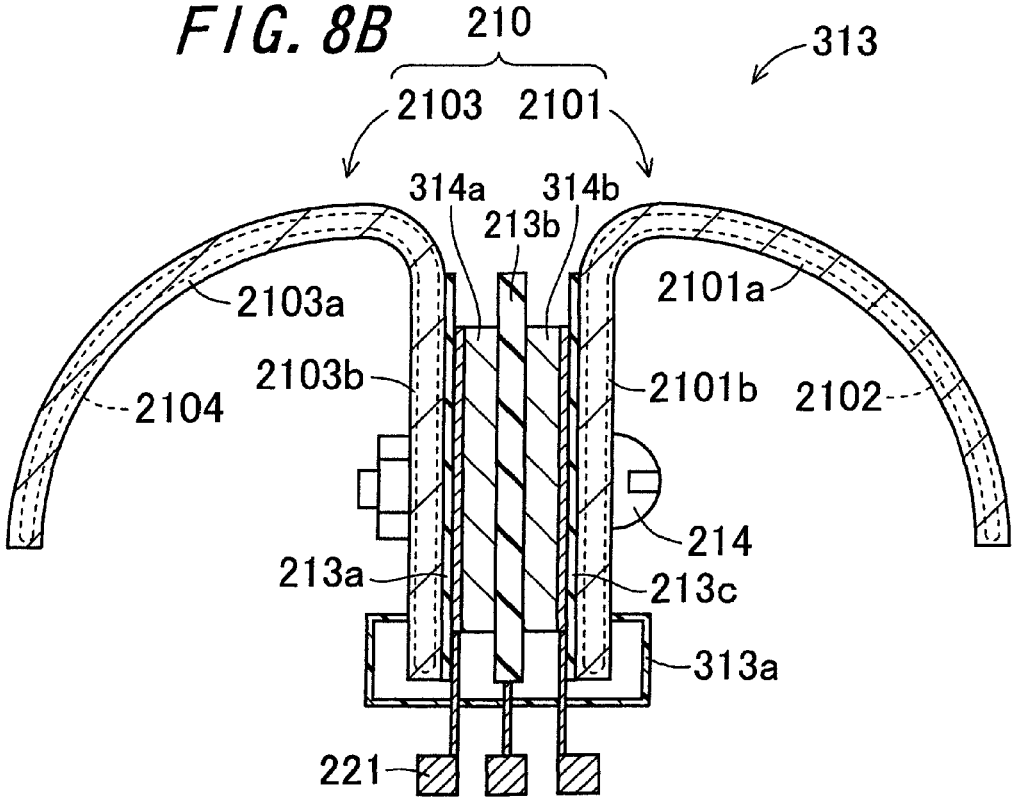

FIGS. 8A and 8B are views showing the configuration of a heating member 313 which is another example of the heating member. FIG. 8A is a plan view of the heating member 313. FIG. 8B is a sectional view taken along the plane orthogonal to the width direction of the heating member 313.

The heating member 313 is similar to the above-described heating member 21, and includes a heat radiating member 210, which is the same as the heat radiating member of the heating member 21, and a heat generating member 314. The heat generating member 314 is a rectangular plate-shaped member that extends in the longitudinal direction of the heat radiating member 210 (the width direction of the fixing belt 25). The heat generating member 314 is fastened by a fastening member 313*a* such as a holding member, in a state of being sandwiched between the heat receiving piece 2101*b* of the first heat radiating section 2101 and the heat receiving piece 2103*b* of the second heat radiating section 2103.

The heat generating member 314 has a laminated structure in which a first insulator layer 213*a*, a first heat generating layer 314*a*, a second insulator layer 213*b*, a second heat generating layer 314*b*, and a third insulator layer 213*c* are laminated in this order. In this case, the second insulator layer 213*b* serves as an intermediate layer that is interposed between the first heat generating layer 314*a* and the second heat generating layer 314*b*. In the heat generating member 314, the first insulator layer 213*a* that is formed on one surface of the first heat generating layer 314*a* in the thickness direction thereof is provided to be in surface-contact with the heat receiving piece 2103*b* of the second heat radiating section 2103, and the third insulator layer 213*c* that is formed on the other surface of the second heat generating layer 314*b* in the thickness direction thereof is provided to be in surface-contact with the heat receiving piece 2101*b* of the first heat radiating section 2101. That is, the heat generating member 314 is configured such that both surfaces in the thickness direction thereof, which are two surfaces having a larger area in descending order, are in surface-contact with the heat receiving piece 2101*b* and the heat receiving piece 2103*b* constituting the heat receiving sections of the heat radiating member 210.

The first insulator layer 213*a*, the second insulator layer 213*b*, and the third insulator layer 213*c* are formed of a material having heat resistance and electrical insulation. The material having heat resistance and electrical insulation is not particularly limited, and a heat resistant polymer material such as polyimide resin, or a ceramic material such as alumina, may be used.

The first heat generating layer 314*a* is configured such that a plurality of rectangular plate-shaped semiconductor ceramic elements 3141, which are resistance heat generating elements, are arranged at an interval in the longitudinal direction of the heat radiating member 210 corresponding to the width direction of the fixing belt 25. The second heat generating layer 314*b* is configured such that a plurality of rectangular plate-shaped semiconductor ceramic elements 3142, which are resistance heat generating elements, are arranged at an interval in the longitudinal direction of the heat radiating member 210 corresponding to the width direction of the fixing belt 25. The semiconductor ceramic elements 3141 constituting the first heat generating layer 314*a* and the semiconductor ceramic elements 3142 constituting the second heat generating layer 314*b* are provided in a staggered manner when viewed from the direction orthogonal to the width direction of the fixing belt 25.

In the case of the heat generating member 314 thus configured, adjustment is possible such that a desired heat generation distribution on the surface of the heat generating member 314 is obtained, and the heat generation capability of the heat radiating member 210 with respect to a specific region of the fixing belt 25 can be controlled. Energization can be provided to the semiconductor ceramic elements 3141 and 3142 by applying a voltage to the three power supply terminals 221. A larger number of semiconductor ceramic elements can be provided, and thus a high-power-density heat generating member can be realized.

Figure 9:
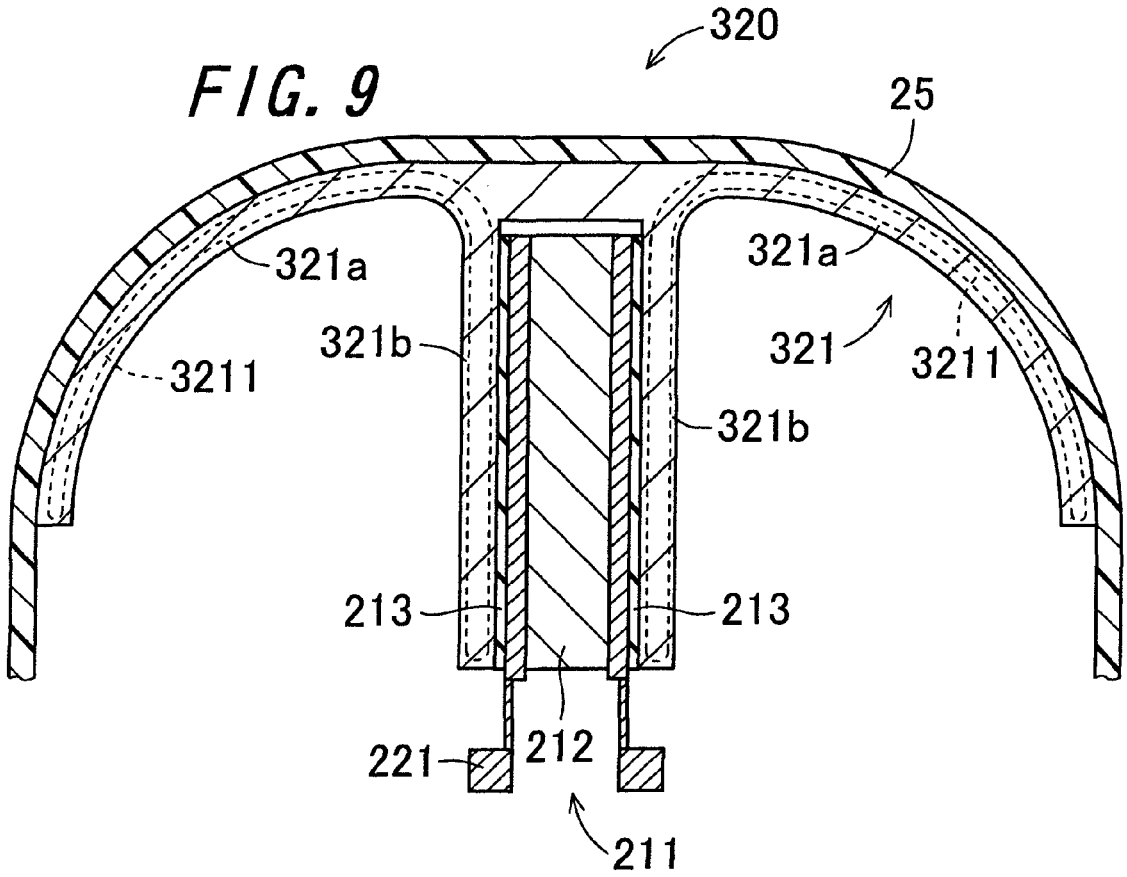
FIG. 9 is a view showing the configuration of a heating member which is another example of the heating member.

FIG. 9 is a view showing the configuration of a heating member 320 which is another example of the heating member. The heating member 320 is similar to the above-described heating member 21, and includes a heat radiating member 321 and a heat generating member 211, which is the same as the heat generating member provided in the heating member 21.

The heat radiating member 321 is formed of the same material as the heat radiating member 210 provided in the above-described heating member 21. The heat radiating member 321 includes a heat receiving section 321*b* that is provided to be in contact with a plurality of surfaces of the heat generating member 211 and receives heat generated by the heat generating member 211, and a heat transfer section 321*a* that transfers heat received by the heat receiving section 321*b* to the fixing belt 25. A heat transport section is provided inside the heat radiating member 321 to transport heat generated by the heat generating member 211 in the width direction and the circumferential direction of the fixing belt 25. Similarly to the heat transport section provided inside the above-described heat radiating member 210, the heat transport section provided inside the heat radiating member 321 includes a meandering capillary tube heat pipe 3211 (hereinafter, simply referred to as "heat pipe 3211"), and is formed over the entire region inside the heat radiating member 321, that is, over the entire region inside the heat transfer section 321*a* and the heat receiving section 321*b*.

The heat transfer section 321*a* is a portion that is formed to extend in the width direction of the fixing belt 25, and has a semicircular cylindrical shape that is curved along the inner circumferential surface of the fixing belt 25, and that transfers heat received by the heat receiving section 321*b* to the fixing belt 25. The heat receiving section 321*b* is a portion that is formed to be bent downward in the vertical direction from the central portion of the heat transfer section 321*a* in the circumferential direction thereof corresponding to the central portion of the fixing belt 25 in the circumferential direction thereof. A concave portion is formed which is surrounded by a vertically parallel inner surface extending from the central portion of the region where the heat transfer section 321*a* is in contact with the fixing belt 25. In the heat radiating section 321, the heat generating member 211 is fitted into the concave portion of the heat receiving section 321*b* and fixed. In a state where the heat generating member 211 is fitted into the concave portion of the heat receiving section 321*b*, both surfaces in the thickness direction thereof are provided to be in surface-contact with the inner surface of the concave portion.

In the heating member 320 thus configured, heat received by the heat receiving section 321*b*, which is provided to be in surface-contact with both surfaces of the heat generating member 211 in the thickness direction thereof on the inner surface of the concave portion, moves along the heat radiating member 321 by thermal conduction, and, simultaneously, is transported in the width direction and the circumferential direction of the fixing belt 25 by the heat pipe 3211, and is transferred from the heat transfer section 321*a* to the fixing belt 25, thereby heating the fixing belt 25. For this reason, a uniform temperature distribution in the width direction and the circumferential direction of the fixing belt 25 is achieved, such that a high-quality fixed image can be obtained.

In the heating member 320, the heat capacity of portions of the heat radiating member 321 where the heat transfer section 321*a* and the heat receiving section 321*b* are bonded to each other becomes larger than the above-described heat radiating member 210 having two heat radiating sections. However, the heat radiating member 321 provided in the heating member 320 is configured such that the heat transfer section 321*a* and the heat receiving section 321*b* are formed as a single body. Therefore, the strength of the heat radiating member itself can be increased, and the width of the heating nip region to the fixing belt 25 can be increased. As a result, it is possible to cope with high-speed printing.

Figure 10:
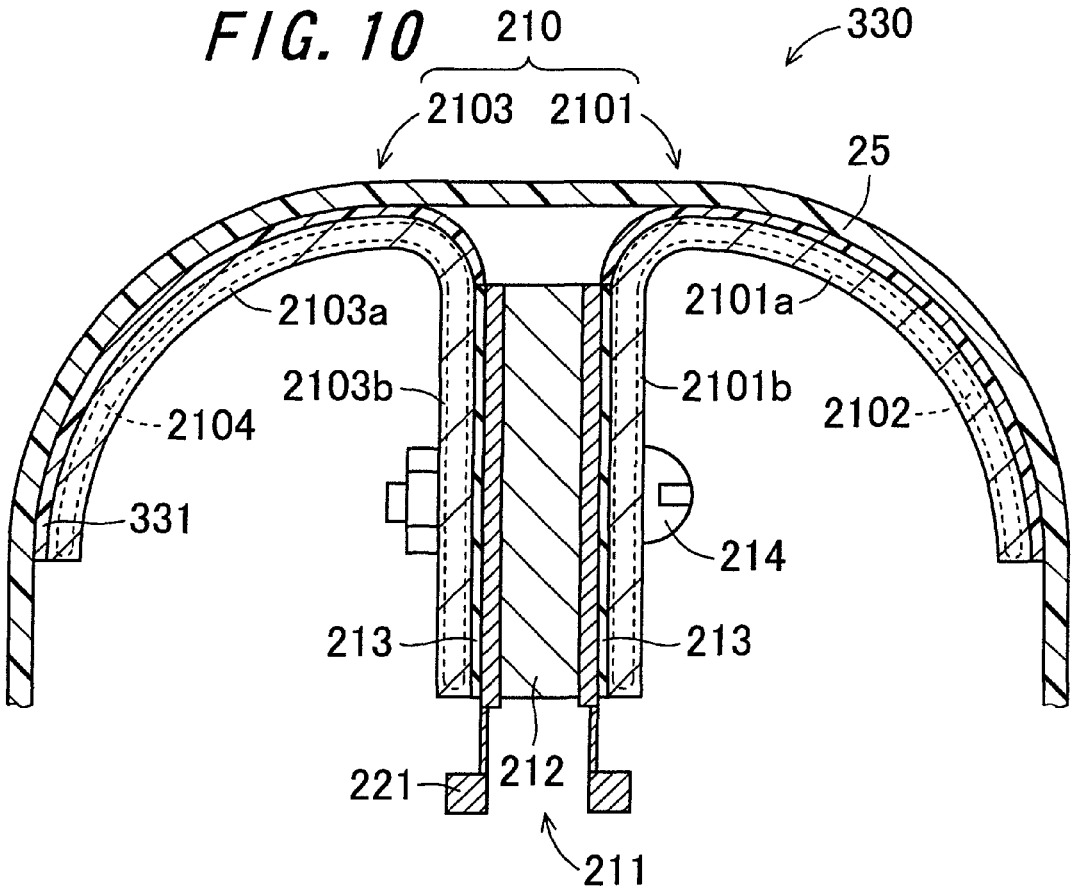
FIG. 10 is a view showing the configuration of a heating member which is another example of the heating member.

FIG. 10 is a view showing the configuration of a heating member 330 which is another example of the heating member. The heating member 330 is similar to the above-described heating member 21, and is the same as the heating member 21, except that slide easing layers 331 are formed on the outer circumferential surfaces of the heat transfer piece 2101*a* and the heat transfer piece 2103*a* to be in contact with the inner circumferential surface of the fixing belt 25. The slide easing layers 331 may be formed on the outer circumferential surfaces of the heat transfer piece 2101*a* and the heat transfer piece 2103*a* of the above-described heating member 311 or 313, or the outer circumferential surfaces of the heat transfer sections 321*a* of the heating member 320.

The slide easing layers 331 are layers provided to reduce friction resistance to the fixing belt 25. Thus, the frictional force between the heat transfer pieces 2101*a* and 2103*a* constituting the heat transfer sections of the heat radiating member 210 and the fixing belt 25, and thus the fixing belt 25 can smoothly rotate.

The slide easing layers 331 are preferably formed of a material having a low friction coefficient and satisfactory thermal conductivity. Thus, the heat transfer efficiency by the heat transfer pieces 2101*a* and 2103*a* constituting the heat transfer sections of the heat radiating member 210 with respect to the fixing belt 25 can be prevented from being deteriorated, and thus it is possible to rotate the fixing belt 25 smoothly.

Examples of the material for the slide easing layers 331 include fluorine resin, such as PTFE or PFA, or a mixture of a plurality of fluorine resin materials. The slide easing layers 331 may be formed of a material that is obtained by adding a filler such as mica, to the fluorine resin material, such that the layers have high strength, thereby improving durability. The slide easing layers 331 may contain, as an additive, a material having satisfactory thermal conductivity, for example, fine powder of graphite, an inorganic or organic conductive filler, or metal powder such as aluminum or magnesium. As the material having satisfactory thermal conductivity as the additive to the slide easing layers 331, a material that is subjected to surface treatment so as to improve dispersibility in the layers may be used.

The thickness of the slide easing layers 331 is set in a range of 15 to 100 μm (in this embodiment, 30 μm) from a viewpoint of thermal conductivity and durability.

Figure 11:
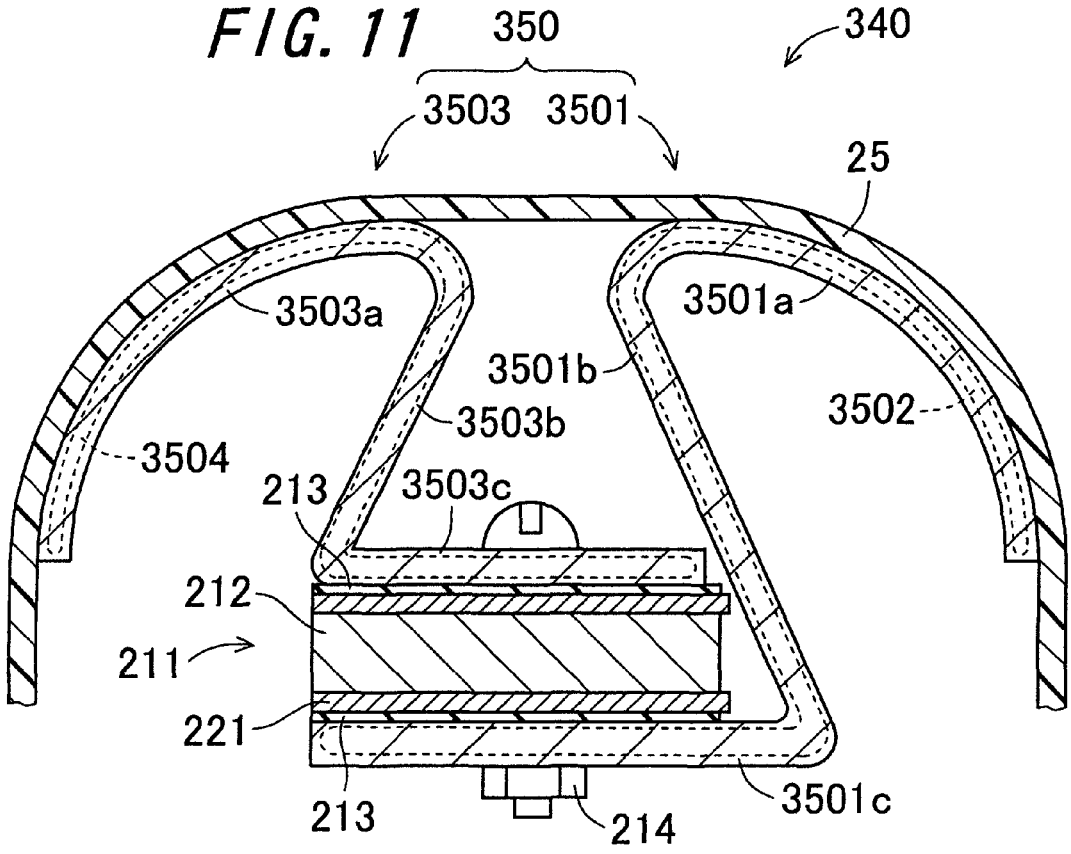
FIG. 11 is a view showing the configuration of a heating member which is another example of the heating member.

FIG. 11 is a view showing the configuration of a heating member 340 which is another example of the heating member. The heating member 340 is similar to the above-described heating member 21, and includes a heat radiating member 350 and a heat generating member 211, which is the same as the heat generating member provided in the heating member 21.

The heat radiating member 350 is formed of the same material as the heat radiating member 210 provided in the above-described heating member 21. The heat radiating member 350 includes a heat receiving section that is provided to be in contact with a plurality of surfaces of the heat generating member 211 and receives heat generated by the heat generating member 211, and a heat transfer section that transfers heat received by the heat receiving section to the fixing belt 25. A heat transport section is provided inside the heat radiating member 350 to transport heat generated by the heat generating member 211 in the width direction and the circumferential direction of the fixing belt 25. In this embodiment, the heat radiating member 350 includes a first heat radiating section 3501 and a second heat radiating section 3503.

The first heat radiating section 3501 includes a heat transfer piece 3501*a*, a connection portion 3501*b*, and a heat receiving piece 3501*c*. The heat receiving piece 3501*c* is a portion that extends in the width direction of the fixing belt (the axial direction of the fixing roller 15*a*), and has a vertically orthogonal surface extending from the central portion of the region where the heat radiating member 350 is in contact with the fixing belt 25, and that is provided to be in contact with one surface of the heat generating member 211 in the thickness direction thereof and receives heat generated by the heat generating member 211. The heat transfer piece 3501*a* is a portion that is formed to extend in the width direction of the fixing belt 25, and that is provided to be curved along the inner circumferential surface of the fixing belt 25, and transfers heat received by the heat receiving piece 3501*c* to the fixing belt 25. The connection portion 3501*b* is a portion that connects one end of the heat transfer piece 3501*a* in the circumferential direction thereof and one end of the heat receiving piece 3501*c*, and that transfers heat received by the heat receiving piece 3501*c* to the heat transfer piece 3501*a*.

The second heat radiating section 3503 includes a heat transfer piece 3503*a*, a connection portion 3503*b*, and a heat receiving piece 3503*c*. The heat receiving piece 3503*c* is a portion that extends in the width direction of the fixing belt (the axial direction of the fixing roller 15*a*), and has a vertically orthogonal surface extending from the central portion of the region where the heat radiating member 350 is in contact with the fixing belt 25, and that is provided to be in contact with the other surface of the heat generating member 211 in the thickness direction thereof, and receives heat generated by the heat generating member 211. The heat transfer piece 3503*a* is a portion that is formed to extend in the width direction of the fixing belt 25, and that is provided to be curved along the inner circumferential surface of the fixing belt 25, and transfers heat received by the heat receiving piece 3503*c* to the fixing belt 25. The connection portion 3503*b* is a portion that connects one end of the heat transfer piece 3503*a* in the circumferential direction thereof and one end of the heat receiving piece 3503*c*, and that transfers heat received by the heat receiving piece 3503*c* to the heat transfer piece 3503*a*.

In the heat radiating member 350 including the first heat radiating section 3501 and the second heat radiating section 3503, the heat receiving piece 3501*c* of the first heat radiating section 3501 and the heat receiving piece 3503*c* of the second heat radiating section 3503 are arranged to be opposite to each other. In the heat radiating member 350, the heat receiving piece 3501*c* of the first heat radiating section 3501 and the heat receiving piece 3503*c* of the second heat radiating section 3503 are combined with each other to form the heat receiving section, which is in contact with both surfaces of the heat generating member 211 in the thickness direction thereof, which surface are two surfaces having a larger area in descending order from among the surfaces constituting the heat generating member 211, to sandwich the heat generating member 211. The heat transfer piece 3501*a* of the first heat radiating section 3501 and the heat transfer piece 3503*a* of the second heat radiating section 3503 are combined with each other to form the semicircular cylindrical heat transfer section.

The heat transport section is provided inside the first heat radiating section 3501 and the second heat radiating section 3503 constituting the heat radiating member 350. The heat transport section transports heat, which is received from the heat generating member 211 by the heat receiving pieces 3501*c* and 3503*c* of the heat radiating sections 3501 and 3503, in the width direction and the circumferential direction of the fixing belt 25. In this embodiment, similarly to the heat transport section that is formed inside the heat radiating section 210, the heat transport section that is provided inside the first heat radiating section 3501 includes a meandering capillary tube heat pipe 3502 (hereinafter, simply referred to as "heat pipe 3502"), and is formed over the entire region inside the first heat radiating section 3501, that is, over the entire region inside the heat transfer piece 3501*a*, the connection portion 3501*b*, and the heat receiving piece 3501*c*. The heat transport section that is provided inside the second heat radiating section 3503 includes a meandering capillary tube heat pipe 3504 (hereinafter, simply referred to as "heat pipe 3504"), and is formed over the entire region inside the second heat radiating section 3503, that is, over the entire region inside the heat transfer piece 3503*a*, the connection portion 3503*b*, and the heat receiving piece 3503*c*.

The slide easing layers 331 of the above-described heating member 330 may be formed on the outer circumferential surfaces of the heat transfer piece 3501*a* and the heat transfer piece 3503*a* to be in contact with the inner circumferential surface of the fixing belt 25.

In the heating member 340 thus configured, heat received by the heat receiving piece 3501*c* and the heat receiving piece 3503*c*, which are provided to be in surface-contact with both surfaces of the heat generating member 211 in the thickness direction thereof, moves along the heat radiating member 350 by thermal conduction, and, simultaneously, is transported in the width direction and the circumferential direction of the fixing belt 25 by the heat pipes 3502 and 3504, and is transferred to the heat transfer pieces 3501*a* and 3503*a* through the connection portions 3501*b* and 3503*b*, thereby heating the fixing belt. For this reason, a uniform temperature distribution in the width direction and the circumferential direction of the fixing belt 25 is achieved, and thus a high-quality fixed image can be obtained.

Figure 12:
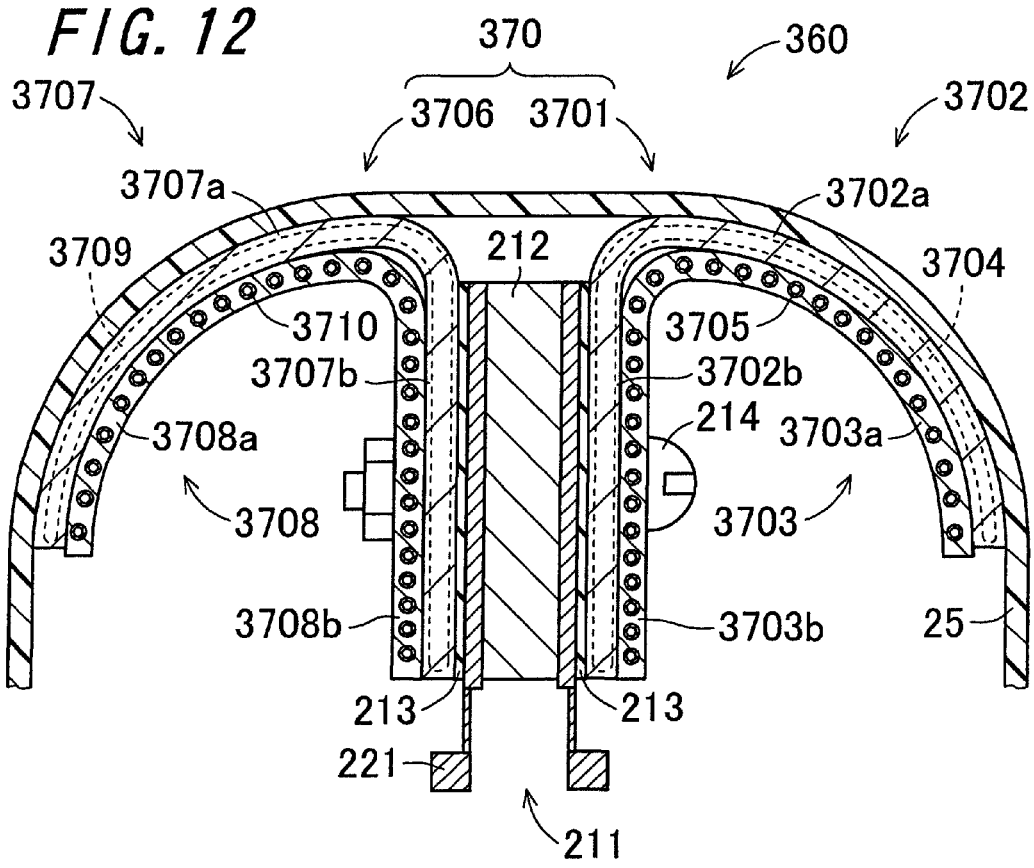
FIG. 12 is a view showing the configuration of a heating member which is another example of the heating member.

FIG. 12 is a view showing the configuration of a heating member 360 which is another example of the heating member. The heating member 360 is similar to the above-described heating member 21, and includes a heat radiating member 370 and a heat generating member 211, which is the same as the heat generating member provided in the heating member 21.

The heat radiating member 370 is formed of the same material as the heat radiating member 210 provided in the heating member 21. The heat radiating member 370 includes a first heat radiating region 3701 and a second heat radiating region 3706.

The first heat radiating region 3701 includes a first heat radiating section 3702 and a second heat radiating section 3703 that are two heat radiating sections provided to be in contact with each other. The first heat radiating section 3702 includes a heat transfer piece 3702*a* and a heat receiving piece 3702*b*. The heat receiving piece 3702*b* is a portion that extends in the width direction of the fixing belt 25 (the axial direction of the fixing roller 15*a*), and has a vertically parallel surface extending from the central portion of the region where the heat radiating member 370 is in contact with the fixing belt 25, and that is provided to be in contact with one surface of the heat generating member 211 in the thickness direction thereof, and receives heat generated by the heat generating member 211. The heat transfer piece 3702*a* is a portion that is formed to extend in the width direction of the fixing belt 25 from one end of the heat receiving piece 3702*b*, and that is provided to be curved along the inner circumferential surface of the fixing belt 25 and transfers heat received by the heat receiving piece 3702*b* to the fixing belt 25. The second heat radiating section 3703 includes a heat transfer piece 3703*a* and a heat receiving piece 3703*b*. The heat receiving piece 3703*b* is a portion that extends in the width direction of the fixing belt 25 (the axial direction of the fixing roller 15*a*), and has a vertically parallel surface extending from the central portion of the region where the heat radiating member 370 is in contact with the fixing belt 25, and that is provided to be in contact with the heat receiving piece 3702*b* and introduces heat received by the heat receiving piece 3702*b* into the second heat radiating section 3703. The heat transfer piece 3703*a* is a portion that is formed to extend in the width direction of the fixing belt 25 from one end of the heat receiving piece 3703*b*, and that is provided to be curved along the inner circumferential surface of the heat transfer piece 3702*a*, and transfers heat introduced by the heat receiving piece 3703*b* to the heat transfer piece 3702*a*.

The second heat radiating region 3706 includes a third heat radiating section 3707 and a fourth heat radiating section 3708 that are two heat radiating section provided to be in contact with each other. The third heat radiating section 3707 includes a heat transfer piece 3707*a* and a heat receiving piece 3707*b*. The heat receiving piece 3707*b* is a portion that extends in the width direction of the fixing belt 25 (the axial direction of the fixing roller 15*a*), and has a vertically parallel surface extending from the central portion of the region where the heat radiating member 370 is in contact with the fixing belt 25, and that is provided to be in contact with the other surface of the heat generating member 211 in the thickness direction thereof and receives heat generated by the heat generating member 211. The heat transfer piece 3707*a* is a portion that is formed to extend in the width direction of the fixing belt 25 from one end of the heat receiving piece 3707*b*, and that is provided to be curved along the inner circumferential surface of the fixing belt 25 and transfers heat received by the heat receiving piece 3707*b* to the fixing belt 25. The fourth heat radiating section 3708 includes a heat transfer piece 3708*a* and a heat receiving piece 3708*b*. The heat receiving piece 3708*b* is a portion that extends in the width direction of the fixing belt 25 (the axial direction of the fixing roller 15*a*), and has a vertically parallel surface extending from the central portion of the region where the heat radiating member 370 is in contact with the fixing belt 25, and that is provided to be in contact with the heat receiving piece 3707*b* and introduces heat received by the heat receiving piece 3707*b* into the fourth heat radiating section 3708. The heat transfer piece 3708*a* is a portion that is formed to extend in the width direction of the fixing belt 25 from one end of the heat receiving piece 3708*b*, and that is provided to be curved along the inner circumferential surface of the heat transfer piece 3707*a* and transfers heat introduced by the heat receiving piece 3708*b* to the heat transfer piece 3707*a*.

In the heat radiating member 370 including the first heat radiating region 3701 and the second heat radiating region 3706, the heat receiving pieces 3702*b* and 3703*b* of the first heat radiating region 3701 are arranged to be opposite to the heat receiving pieces 3707*b* and 3708*b* of the second heat radiating region 3706. In the heating member 360, the heat receiving pieces 3702*b* and 3703*b* of the first heat radiating region 3701 and the heat receiving pieces 3707*b* and 3708*b* of the second heat radiating region 3706 are combined with each other to form the heat receiving section, which is in contact with both surfaces of the heat generating member 211 in the thickness direction thereof to sandwich the heat generating member 211. The heat transfer pieces 3702*a* and 3703*a* of the first heat radiating region 3701 and the heat transfer pieces 3707*a* and 3708*a* of the second heat radiating region 3706 are combined with each other to form the semicircular cylindrical heat transfer section.

A heat transport section is provided inside the first heat radiating section 3702 and the second heat radiating section 3703 constituting the first heat radiating region 3701 and the third heat radiating section 3707 and the fourth heat radiating section 3708 constituting the second heat radiating region 3706.

In this embodiment, similarly to the heat transport section that is provided inside the above-described heat radiating member 210, the heat transport section that is provided inside the first heat radiating section 3702 includes a meandering capillary tube heat pipe 3704 (hereinafter, simply referred to as "heat pipe 3704"), and is formed over the entire region inside the first heat radiating section 3702, that is, over the entire region inside the heat transfer piece 3702*a* and the heat receiving piece 3702*b*. Similarly to the heat transport section that is provided inside the heat radiating member 210, the heat transport section that is provided inside the second heat radiating section 3703 includes a meandering capillary tube heat pipe 3705 (hereinafter, simply referred to as "heat pipe 3705"), and is formed over the entire region inside the second heat radiating section 3703, that is, over the entire region inside the heat transfer piece 3703*a* and the heat receiving piece 3703*b*. Similarly to the heat transport section that is provided inside the heat radiating member 210, the heat transport section that is provided inside the third heat radiating section 3707 includes a meandering capillary tube heat pipe 3709 (hereinafter, simply referred to as "heat pipe 3709"), and is formed over the entire region inside the third heat radiating section 3707, that is, over the entire region inside the heat transfer piece 3707*a* and the heat receiving piece 3707*b*. Similarly to the heat transport section that is provided inside the above-described heat radiating member 210, the heat transport section that is provided inside the fourth heat radiating section 3708 includes a meandering capillary tube heat pipe 3710 (hereinafter, simply referred to as "heat pipe 3710"), and is formed over the entire region inside the fourth heat radiating section 3708, that is, over the entire region inside the heat transfer piece 3708*a* and the heat receiving piece 3708*b*.

The respective heat pipes 3704 and 3709 that are formed inside the first heat radiating section 3702 of the first heat radiating region 3701 and the third heat radiating section 3707 of the second heat radiating region 3706 transport heat, which is received from the heat generating member 211 by the respective heat receiving pieces 3702*b* and 3707*b* of the respective heat radiating sections 3702 and 3707, along the width direction and the circumferential direction of the fixing belt 25. The respective heat pipes 3705 and 3710 that are formed inside the second heat radiating section 3703 of the first heat radiating region 3701 and the fourth heat radiating section 3708 of the second heat radiating region 3706 transport heat, which is introduced from the respective heat receiving pieces 3702*b* and 3707*b* by the respective heat receiving pieces 3703*b* and 3708*b* of the respective heat radiating sections 3703 and 3708, in the longitudinal direction of the heat transfer pieces 3702*a* and 3707*a* corresponding to the width direction of the fixing belt 25 and in the short-side direction of the heat transfer pieces 3702*a* and 3707*a* corresponding to the circumferential direction of the fixing belt 25.

In the heating member 360 thus configured, heat, which is received by the heat receiving piece 3702*b* provided to be in contact with one surface of the heat generating member 211 in the thickness direction thereof and the heat receiving piece 3707*b* provided to be in contact with the other surface of the heat generating member 211 in the thickness direction thereof, moves along the first heat radiating section 3702 and the third heat radiating section 3707 by thermal conduction, and, simultaneously, is transported in the width direction and the circumferential direction of the fixing belt 25 by the heat pipes 3704 and 3709, and is transferred from the heat transfer piece 3702*a* and the heat transfer piece 3707*a* to the fixing belt 25, thereby heating the fixing belt 25. Heat, which is introduced by the heat receiving piece 3703*b* provided to be in contact with the heat receiving piece 3702*b* and the heat receiving piece 3708*b* provided to be in contact with the heat receiving piece 3707*b*, moves along the second heat radiating section 3703 and the fourth heat radiating section 3708 by thermal conduction, and, simultaneously, is transported in the longitudinal direction and the short-side direction of the heat transfer pieces 3702*a* and 3707*a* by the heat pipes 3705 and 3710, and is transferred from the heat transfer pieces 3703*a* and 3708*a* to the heat transfer pieces 3702*a* and 3707*a* to the fixing belt 25, thereby heating the fixing belt 25. For this reason, a uniform temperature distribution in the width direction and the circumferential direction of the fixing belt 25 is achieved, and thus a high-quality fixed image can be obtained.

Figure 13A:
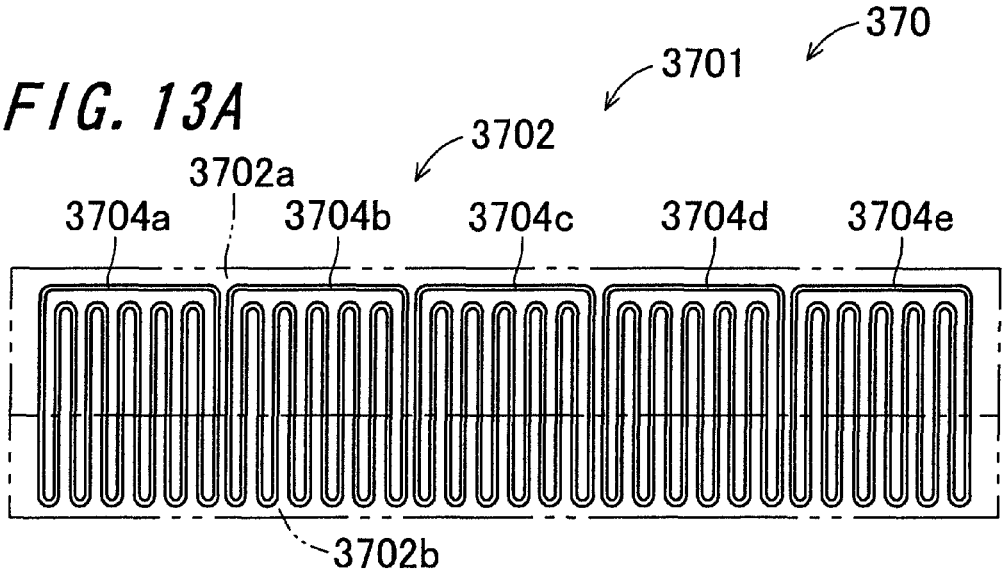
FIGS. 13A and 13B are views showing the configuration of heat pipes that are provided inside a heat radiating member.
Figure 13B:
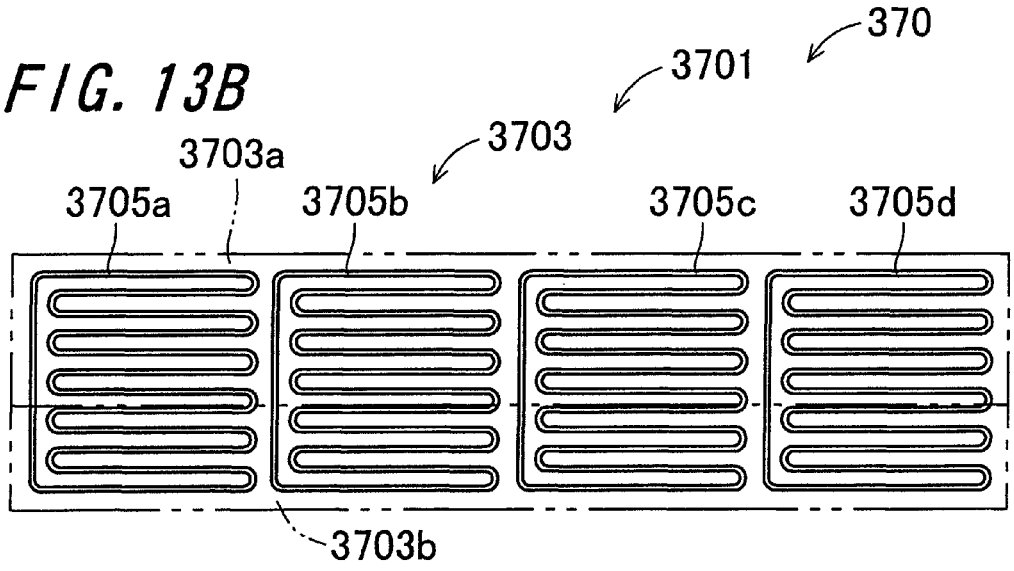

Next, the configuration of heat pipes provided inside the heat radiating member 370 provided in the heating member 360 will be described in detail with reference to FIGS. 13A and 13B. FIGS. 13A and 13B are views showing the configuration of heat pipes that are provided inside the heat radiating member 370. FIG. 13A shows the configuration of a plurality of heat pipes 3704 that are provided inside the first heat radiating section 3702 of the first heat radiating region 3701. The configuration of a plurality of heat pipes 3709 that are provided inside the third heat radiating section 3707 of the second heat radiating region 3706 is the same as the configuration of the heat pipes 3704 of the first heat radiating section 3702. FIG. 13B shows the configuration of a plurality of heat pipes 3705 that are provided inside the second heat radiating section 3703 of the first heat radiating region 3701. The configuration of a plurality of heat pipes 3710 that are provided inside the fourth heat radiating section 3708 of the second heat radiating region 3706 is the same as the configuration of the heat pipes 3705 of the second heat radiating section 3703. Hereinafter, description will be provided for the configuration of the plurality of heat pipes 3704 that are provided inside the first heat radiating section 3702 and the configuration of the plurality of heat pipes 3705 that are provided inside the second heat radiating section 3703.

As shown in FIG. 13A, the heat transport section that is provided inside the first heat radiating section 3702 is configured by a combination of a plurality of heat pipes 3704*a*, 3704*b*, 3704*c*, 3704*d*, and 3704*e*, and is formed over the entire region inside the first heat radiating section 3702, that is, over the entire region inside the heat transfer piece 3702*a* and the heat receiving piece 3702*b*.

The respective heat pipes 3704*a*, 3704*b*, 3704*c*, 3704*d*, and 3704*e* are meandering capillary tube heat pipes in which the extension direction of the linear portions are orthogonal to the width direction of the fixing belt 25. The respective heat pipes are arranged in the longitudinal direction of the first heat radiating section 3702 (the width direction of the fixing belt 25) at a predetermined interval. The interval between the respective heat pipes 3704*a*, 3704*b*, 3704*c*, 3704*d*, and 3704*e* is set so as to ensure heat movement by thermal conduction between the respective heat pipes.

In the first heat radiating section 3702 in which the heat pipes 3704*a*, 3704*b*, 3704*c*, 3704*d*, and 3704*e* are provided, the heat transport efficiency in the circumferential direction of the fixing belt 25 is particularly improved.

As shown in FIG. 13B, the heat transport section that is provided inside the second heat radiating section 3703 is configured by a combination of a plurality of heat pipes 3705*a*, 3705*b*, 3705*c*, and 3705*d*, and is formed over the entire region inside the second heat radiating section 3703, that is, over the entire region inside the heat transfer piece 3703*a* and the heat receiving piece 3703*b*.

The respective heat pipes 3705*a*, 3705*b*, 3705*c*, and 3705*d* are meandering capillary tube heat pipes in which the extension direction of the linear portions is in parallel to the width direction of the fixing belt 25. The respective heat pipes are arranged in the longitudinal direction of the second heat radiating section 3703 (the width direction of the fixing belt 25) at a predetermined interval. The interval between the respective heat pipes 3705*a*, 3705*b*, 3705*c*, and 3705*d* is set so as to ensure heat movement by thermal conduction between the respective heat pipes.

In the second heat radiating section 3703 in which the heat pipes 3705*a*, 3705*b*, 3705*c*, and 3705*d* are provided, the heat transport efficiency in the width direction of the fixing belt 25 is particularly improved.

Figure 14A:
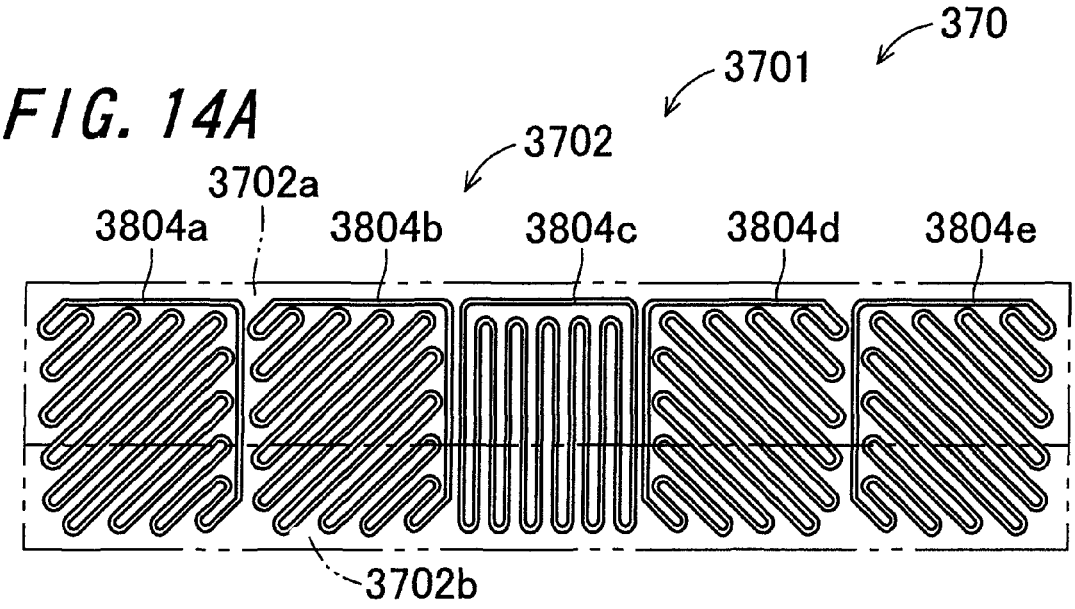
FIGS. 14A and 14B are views showing another configuration example of heat pipes that are provided inside the heat radiating member.
Figure 14B:
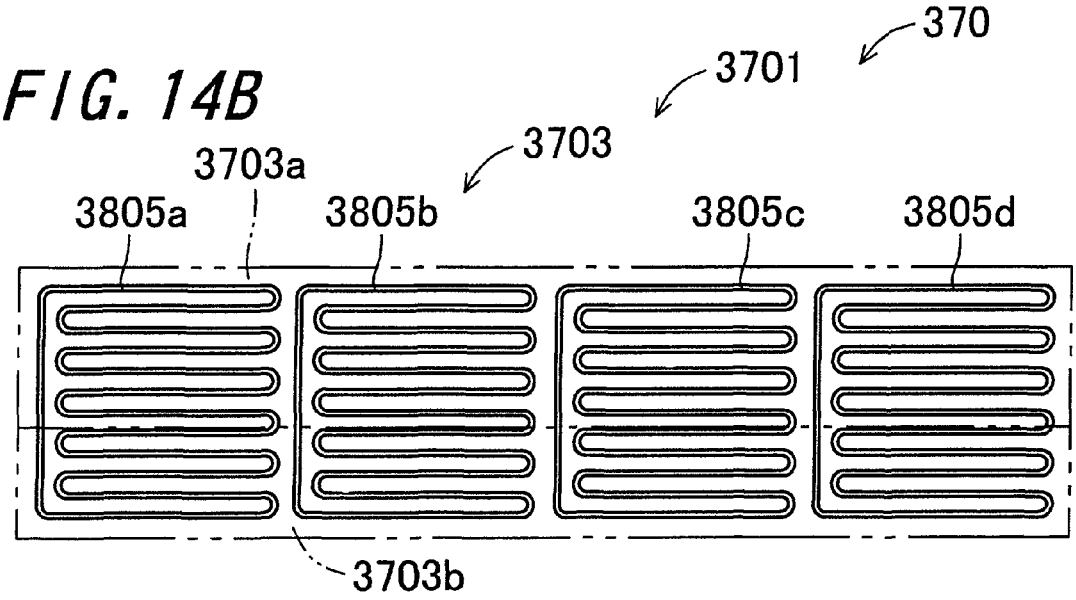

The heat pipes that are provided inside the heat radiating member 370 may be configured as shown in FIGS. 14A and 14B. FIGS. 14A and 14B are views showing another configuration example of heat pipes that are provided inside the heat radiating member 370. FIG. 14A shows the configuration of a plurality of heat pipes 3804 that are provided inside the first heat radiating section 3702 of the first heat radiating region 3701. The configuration of a plurality of heat pipes that are provided inside the third heat radiating section 3707 of the second heat radiating region 3706 is the same as the configuration of the heat pipes 3804 of the first heat radiating section 3702. FIG. 14B shows the configuration of a plurality of heat pipes 3805 that are provided inside the second heat radiating section 3703 of the first heat radiating region 3701. The configuration of a plurality of heat pipes that are provided inside the fourth heat radiating section 3708 of the second heat radiating region 3706 is the same as the configuration of the heat pipe 3805 of the second heat radiating section 3703. Hereinafter, description will be provided for the configuration of a plurality of heat pipes 3804 that are provided inside the first heat radiating section 3702 and the configuration of a plurality of heat pipes 3805 that are provided inside the second heat radiating section 3703.

As shown in FIG. 14A, the heat transport section that is provided inside the first heat radiating section 3702 is configured by a combination of a plurality of heat pipes 3804*a*, 3804*b*, 3804*c*, 3804*d*, and 3804*e*, and is formed over the entire region inside the first heat radiating section 3702, that is, over the entire region inside the heat transfer piece 3702*a* and, the heat receiving piece 3702*b*.

The respective heat pipes 3804*a*, 3804*b*, 3804*d*, and 3804*e* that are arranged at both end portions of the first heat radiating section 3702 in the longitudinal direction thereof corresponding to both end portions of the fixing belt 25 in the width direction thereof are meandering capillary tube heat pipes in which the extension direction of the linear portions are inclined at a predetermined angle in the width direction of the fixing belt 25. The heat pipe 3804*c* that is arranged at the central portion of the first heat radiating section 3702 in the longitudinal direction thereof corresponding to the central portion of the fixing belt 25 in the width direction thereof is a meandering capillary tube heat pipe in which the extension direction of the linear portions is orthogonal to the width direction of the fixing belt 25. The respective heat pipes 3804*a*, 3804*b*, 3804*c*, 3804*d*, and 3804*e* are arranged in the longitudinal direction of the first heat radiating section 3702 (the width direction of the fixing belt 25) at a predetermined interval. The interval between the respective heat pipes 3804*a*, 3804*b*, 3804*c*, 3804*d*, and 3804*e* is set so as to ensure heat movement by thermal conduction between the respective heat pipes.

When the recording paper sheets 32 of a small-width size pass successively through the fixing nip region 15*c*, both end portions of the fixing belt 25 in the width direction thereof (the paper non-passing region) are likely to be heated. In contrast, the respective heat pipes 3804*a*, 3804*b*, 3804*d*, and 3804*e* that are arranged at both end portions of the first heat radiating section 3702 in the longitudinal direction thereof corresponding to both end portions of the fixing belt 25 in the width direction thereof are meandering capillary tube heat pipe in which the extension direction of the linear portions are inclined at a predetermined angle in the width direction of the fixing belt 25. Therefore, heat can be transported rapidly in the width direction and the circumferential direction of the fixing belt 25, and a uniform temperature distribution in the width direction and the circumferential direction of the fixing belt 25 can be achieved. That is, in a case where the resistance heat generating elements of the heat generating member 211 corresponding to the paper non-passing region of the fixing belt 25 are not energized, when the thermal balance of the paper non-passing region is positive, temperature rises and the temperature distribution of the fixing belt 25 becomes uneven. Meanwhile, heat transport from a high-temperature portion to a low-temperature portion can be carried out by the heat transport capability of the heat pipes 3804*a*, 3804*b*, 3804*d*, and 3804*e* that are arranged at both end portions of the first heat radiating section 3702 in the longitudinal direction, such that a uniform temperature distribution of the fixing belt 25 can be achieved.

At the time of a fixing operation of the fixing device 15, the central portion of the fixing belt 25 in the width direction has a small change in temperature, but a large amount of heat is required since the recording paper sheet 32 passes therethrough. In contrast, the heat pipe 3804*c* that is arranged at the central portion of the first heat radiating section 3702 in the longitudinal direction thereof corresponding to the central portion of the fixing belt 25 in the width direction thereof is a meandering capillary tube heat pipe in which the extension direction of the linear portions is orthogonal to the width direction of the fixing belt 25. Therefore, the heat pipe 3804*c* particularly has excellent heat transport efficiency in the circumferential direction of the fixing belt 25. Therefore, high temperature followability of the first heat radiating section 3702 with respect to the central portion of the fixing belt 25 in the width direction thereof where a large amount of heat is required can be maintained.

As shown in FIG. 14B, the heat transport section that is provided inside the second heat radiating section 3703 is configured by a combination of a plurality of heat pipes 3805*a*, 3805*b*, 3805*c*, and 3805*d*, and is formed over the entire region inside the second heat radiating section 3703, that is, over the entire region inside the heat transfer piece 3703*a* and the heat receiving piece 3703*b*.

The respective heat pipes 3805*a*, 3805*b*, 3805*c*, and 3805*d* are meandering capillary tube heat pipes in which the extension direction of the linear portions are in parallel to the width direction of the fixing belt 25. The respective heat pipes are arranged in the longitudinal direction of the second heat radiating section 3703 (the width direction of the fixing belt 25) at a predetermined interval. The interval between the respective heat pipes 3805*a*, 3805*b*, 3805*c*, and 3805*d* is set so as to ensure heat movement by thermal conduction between the respective heat pipes.

In the second heat radiating section 3703 in which the heat pipes 3805*a*, 3805*b*, 3805*c*, and 3805*d* are provided, the heat transport, efficiency in the width direction of the fixing belt 25 is particularly improved.

The slide easing layers 331 of the above-described heating member 330 may be formed on the outer circumferential surface of the heat transfer piece 3702*a* of the first heat radiating section 3702 and the outer circumferential surface of the heat transfer piece 3707*a* of the third heat radiating section 3707, to be in contact with the inner circumferential surface of the fixing belt 25.

Figure 15:
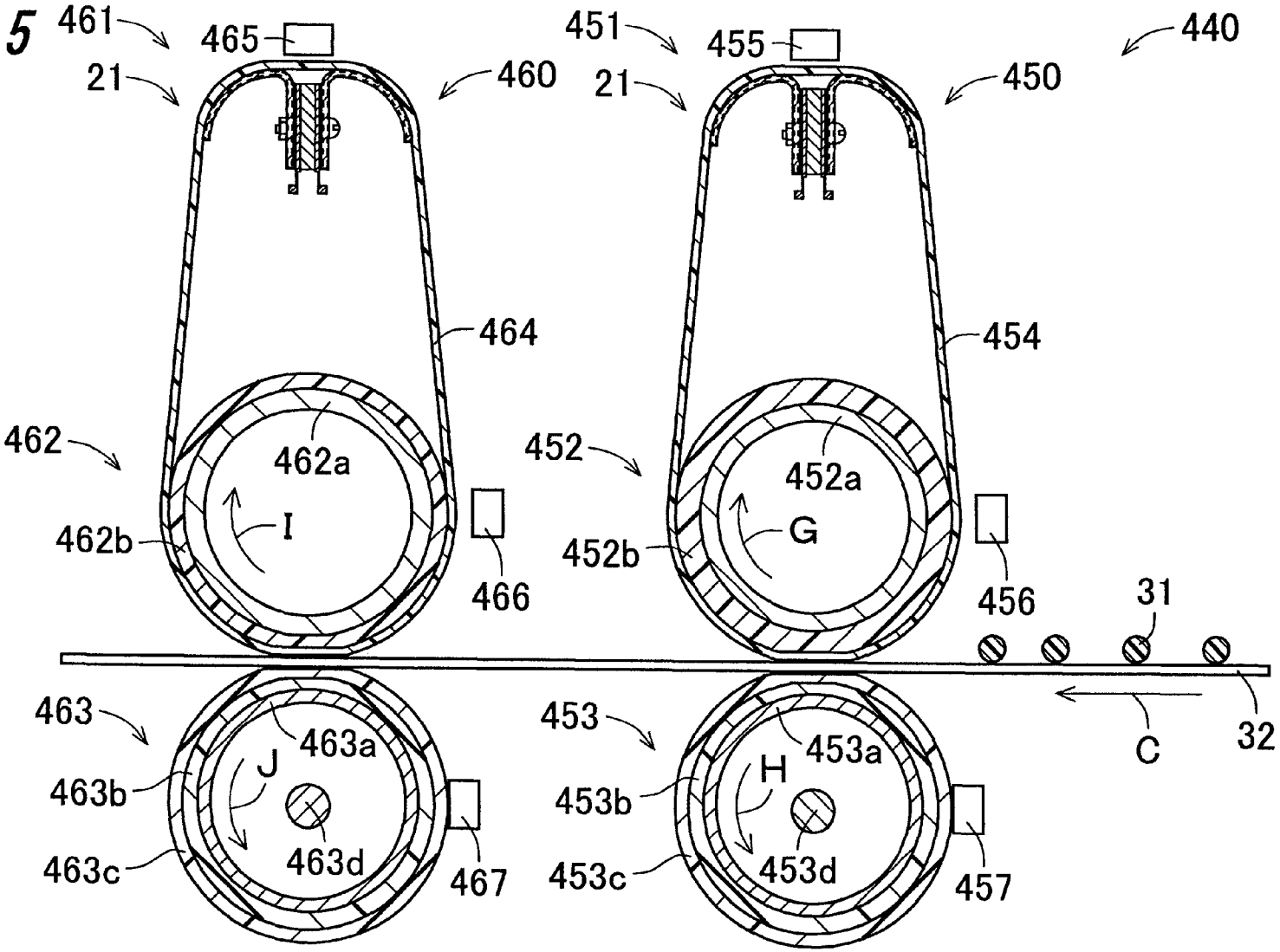
FIG. 15 is a view showing the configuration of a fixing device according to a second embodiment of the invention.

FIG. 15 is a view showing the configuration of a fixing device 440 according to a second embodiment of the invention. The fixing device 440 is a fixing device of two-stage fixing type, and includes a first fixing section 450 that performs primary fixing of the unfixed toner images 31 onto the recording paper sheet 32 under application of heat and pressure, and a second fixing section 460 that is arranged on the downstream side in the conveyance direction of the recording paper sheet 32 from the first fixing section 450 and performs secondary fixing of the toner images 31 after the primary fixing onto the recording paper sheet 32 under application of heat and pressure. The first fixing section 450 and the second fixing section 460 are arranged side by side in the horizontal direction. In the fixing device 440, the first fixing section 450 and the second fixing section 460 are the fixing device 15 of the above-described embodiment that includes the heating member, in which the heat radiating member having the meandering capillary tube heat pipes is provided to be in contact with a plurality of surfaces of the heat generating member.

In the fixing device 440 of two-stage fixing type thus configured, when the resistance heat generating elements provided in the first fixing section 450 and the second fixing section 460 are energized, a uniform temperature distribution on the surface of each of the heat transfer sections of the heat radiating members provided in the first fixing section 450 and the second fixing section 460 is achieved. Therefore, a uniform temperature distribution in the width direction and the circumferential direction of each of the fixing belts 454 and 464 is achieved, and heat generation by the respective resistance heat generating elements is stably carried out, such that heat generation efficiency is prevented from being deteriorated. For this reason, the fixing device 440 of two-stage fixing type can obtain a high-quality fixed image and can reduce the warm-up time.

A guide member, such as a transport guide plate or a transport roller, is provided between the first fixing section 450 and the second fixing section 460. A recording paper sheet 32 that is subjected to fixing in the fixing nip region of the first fixing section 450 is transported along the guide member, subjected to fixing in the fixing nip region of the second fixing section 460, and discharged. The fixing device 440 can be mounted in the image forming apparatus 100, instead of the fixing device 15.

The first fixing section 450 includes a first heating section 451, a first fixing roller 452, a first pressure roller 453, and a first fixing belt 454 which is the same as the above-described fixing belt 25. In the first fixing section 450, the first fixing belt 454 is supported around the first fixing roller 452 and the first heating section 451 with tension, and the first pressure roller 453 is arranged to be opposite to the first fixing roller 452 with the first fixing belt 454 interposed therebetween.

The first heating section 451 has the above-described heating member 21. The heating member 21 provided in the first heating section 451 includes the above-described heat radiating member 210, and the heat generating member 211 having the above-described heat generating layer 212 in which the heat generating region is divided into three regions which are both end portions and the central portion of the heat radiating member 210 in the longitudinal direction thereof.

In this embodiment, the heat radiating member 210 includes a first heat radiating section and a second heat radiating section, each of which is manufactured by using a thin metal plate formed of aluminum and having a thickness of 0.5 mm. The contact portions with the first fixing belt 454 formed by the heat transfer section of the first heat radiating section and the heat transfer section of the second heat radiating section are configured such that a sectional diameter is 40 mm and an opening portion has an opening angle of 125°. In the contact portions, heat generated by the heat generating layer 212 is transferred to the first fixing belt 454.

As described above, the heat generating layer 212 is divided into a first heat generating region 212*a* and a second heat generating region 212*b* corresponding to both end portions of each heat transfer section of the heat radiating member 210 in the longitudinal direction thereof, and a third heat generating region 212*c* corresponding to the central portion of each heat transfer section of the heat radiating member 210 in the longitudinal direction thereof, and the heat generating regions can be energized separately. By controlling energization of the respective heat generating regions appropriately in accordance with the size or thickness of the recording paper sheet 32, the heat generating layer 212 generates heat. In this embodiment, the heat generating layer 212 generates heat with the amount of heat generation of 1100 W. The amount of heat generation of the third heat generating region 212*c* is 600 W, and the amount of heat generation of each of the first heat generating region 212*a* and the second heat generating region 212*b* is 250 W.

A first heating element-side thermistor 455 is arranged around the circumferential surface of the first fixing belt 454 wound around the first heating section 451 to detect the temperature of the circumferential surface in a non-contact manner.

The first fixing roller 452 comes into pressure-contact with the first pressure roller 453 with the first fixing belt 454 interposed therebetween to form the fixing nip region, and is driven to rotate in a rotation direction G around the rotation axis by a drive motor (not shown), thereby conveying the first fixing belt 454. The first fixing roller 452 has a two-layered structure in which a core metal 452*a* and an elastic layer 452*b* are formed in this order from inside. For the core metal 452*a*, for example, a metal such as iron, stainless steel, aluminum, or copper, or an alloy thereof is used. In this embodiment, the core metal 452*a* is a member that is formed of aluminum and has an outer diameter of 40 mm. For the elastic layer 452*b*, a heat resistant rubber material such as silicone rubber or fluorine rubber is appropriately used. In this embodiment, the elastic layer 452*b* is a member that is formed of silicone foaming sponge having small thermal conductivity and has a thickness of 5 mm. The surface hardness of the first fixing roller 452 thus configured is 68 degrees (Asker C hardness).

A first fixing roller-side thermistor 456 is arranged around the circumferential surface of the winding portion (heating nip region) of the first fixing roller 452 at which the first fixing belt 454 is wound, to detect the temperature of the circumferential surface of the first fixing belt 454 wound around the first fixing roller 452 in a non-contact manner.

The first pressure roller 453 is opposite to and in pressure-contact with the first fixing roller 452 with the first fixing belt 454 interposed therebetween, and is driven to rotate in a rotation direction H around the rotation axis by a drive motor (not shown). The first fixing belt 454 and the first fixing roller 452, and the first pressure roller 453 rotate reversely with respect to each other. The first pressure roller 453 has a three-layered structure in which a core metal 453*a*, an elastic layer 453*b*, and a release layer 453*c* are formed in this order from inside. For the core metal 453*a*, for example, a metal such as iron, stainless steel, aluminum, or copper, or an alloy thereof is used. In this embodiment, the core metal 453*a* is a member that is formed of aluminum and has an outer diameter of 46 mm. For the elastic layer 453*b*, a heat resistant rubber material such as silicone rubber or fluorine rubber is appropriately used. In this embodiment, the elastic layer 453*b* is a member that is formed of silicone rubber and has a thickness 2 mm. For the release layer 453*c*, fluorine resin such as PFA (a copolymer of tetrafluoroethylene and perfluoroalkyl vinyl ether) or PTFE (polytetrafluoroethylene), is appropriately used. In this embodiment, the release layer 453*c* is a member that is formed of PFA and has a thickness of about 30 μm. The surface hardness of the first pressure roller 453 thus configured is 75 degrees (Asker C hardness).

The first pressure roller 453 is provided with a first heater lamp 453*d* (for example, rated power 400 W) for heating the first pressure roller 453, in an interior thereof. A control circuit (not shown) causes power to be supplied (energized) from a power supply circuit (not shown) to the first heater lamp 453*d*, the first heater lamp 453*d* emits light, and infrared rays are radiated from the first heater lamp 453*d*. Thus, the inner circumferential surface of the first pressure roller 453 absorbs the infrared rays and is heated, such that the entire first pressure roller 453 is heated. A first pressure roller-side thermistor 457 is arranged on the circumferential surface of the first pressure roller 453 to detect the temperature of the circumferential surface of the first pressure roller 453 in a contact manner. An external heater for rapidly heating the surface of the first pressure roller 453, a cleaning roller, and an oil coating roller may be provided in the first pressure roller 453.

The first fixing roller 452 and the first pressure roller 453 have an outer diameter of 50 mm and are in pressure-contact with each other by an elastic member (spring member) (not shown) with a predetermined load (in this case, 600 N). Thus, the fixing nip region is formed between the circumferential surface of the first fixing belt 454 which is supported around the first fixing roller 452 and the first heating section 451, and the circumferential surface of the first pressure roller 453. The fixing nip region refers to a region where the first fixing belt 454 and the first pressure roller 453 come into contact with each other. In this embodiment, the fixing nip region is 9 mm. The first fixing roller 452 is heated to a predetermined temperature (in this case, 180° C.), and the recording paper sheet 32 passes through the fixing nip region, such that the unfixed toner images 31 are heated and molten, and the images are fixed. When the recording paper sheet 32 passes through the fixing nip region, the first fixing belt 454 comes into contact with the toner image forming surface of the recording paper sheet 32, and the first pressure roller 453 comes into contact with the surface of the recording paper sheet 32 opposite to the toner image forming surface.

The recording paper sheet 32 is conveyed to the fixing nip region at a predetermined fixing speed and a copy speed in accordance with the rotation speed of the first fixing roller 452 and the first pressure roller 453, and the unfixed toner images 31 are fixed onto the recording paper sheet 32 under application of heat and pressure. The fixing speed refers to a so-called process speed. In the case of monochrome printing, the fixing speed is 355 mm/sec, and in the case of color printing, the fixing speed is 220 mm/sec. The copy speed refers to the number of copies per minute. In the case of monochrome printing, the copy speed is 70 copies/minute, and in the case of color printing, the copy speed is 60 copies/minute.

A web cleaner (not shown) for cleaning the surface of the first fixing belt 454 is arranged in the first fixing section 450.

The control circuit serving as a temperature control section controls energization to the heat generating layer 310 and the first heater lamp 453*d* through the power supply circuit on the basis of temperature data detected by the respective thermistors 455, 456, and 457, such that the heat radiating member 210 provided in the first heating section 451, the first fixing belt 454, and the first pressure roller 453 are at a predetermined temperature.

Next, the second fixing section 460 will be described. The second fixing section 460 includes a second heating section 461, a second fixing roller 462, a second pressure roller 463, and a second fixing belt 464 which is the same as the above-described fixing belt 25. In the second fixing section 460, the second fixing belt 464 is supported around the second fixing roller 462 and the second heating section 461 with tension, and the second pressure roller 463 is arranged to be opposite to the second fixing roller 462 with the second fixing belt 464 interposed therebetween. The second fixing section 460 has the same basic configuration as the first fixing section 450, except that the second heating section 461 is different from the first heating section 451, and the second fixing roller 462 is different from the first fixing roller 452.

The second heating section 461 has the above-described heating member 21. The heating member 21 provided in the second heating section 461 includes the above-described heat radiating member 210, and a heat generating member having a heat generating layer 212 in which the heat generating region is divided into three regions to correspond to both end portions and the central portion of the heat transfer section of the heat radiating member 210 in the longitudinal direction thereof and two regions in the short-side direction of the heat transfer section of the heat radiating member 210, that is, six regions in total.

The heat radiating member 210 comes into contact with the second fixing belt 464 at the heat transfer section and transfers heat generated by the heat generating layer 212 to the second fixing belt 464.

As described above, the heat generating layer 212 is divided into first to six heat generating regions. The first heat generating region and the second heat generating region correspond to both end portions of the heat transfer section of the heat radiating member 210 in the longitudinal direction and correspond to the downstream side in the rotation direction of the second fixing belt 464. The third heat generating region and the fourth heat generating region correspond to both end portions of the heat transfer section of the heat radiating member 210 in the longitudinal direction and correspond to the upstream side in the rotation direction of the second fixing belt 464. The fifth heat generating region corresponds to the central portion of the heat transfer section of the heat radiating member 210 in the longitudinal direction and corresponds to the downstream side in the rotation direction of the second fixing belt 464. The sixth heat generating region corresponds to the central portion of the heat transfer section of the heat radiating member 210 in the longitudinal direction and corresponds to the upstream side in the rotation direction of the second fixing belt 464. The heat generating regions can be energized separately. By controlling energization of the respective heat generating regions appropriately in accordance with the size or thickness of the recording paper sheet 32, the heat generating layer 212 generates heat. In this embodiment, the heat generating layer 212 generates heat with the amount of heat amount of 900 W. The amount of heat generation of the fifth heat generating region is 400 W, the amount of heat generation of the sixth heat generating region is 200 W, the amount of heat generation of each of the first heat generating region and the second heat generating region is 100 W, and the amount of heat generation of each of the third heat generating region and the fourth heat generating region is 50 W.

A second heating element-side thermistor 465 is arranged around the circumferential surface of the second fixing belt 464 wound around the second heating section 461 to detect the temperature of the circumferential surface in a non-contact manner.

The second fixing roller 462 comes into pressure-contact with the second pressure roller 463 with the second fixing belt 464 interposed therebetween to form the fixing nip region, and is driven to rotate in a rotation direction I around the rotation axis by a drive motor (not shown), thereby conveying the second fixing belt 464. The second fixing roller 462 has a two-layered structure in which a core metal 462*a* and an elastic layer 462*b* are formed in this order from inside. For the core metal 462*a*, for example, a metal such as iron, stainless steel, aluminum, or copper, or an alloy thereof is used. In this embodiment, the core metal 462*a* is a member that is formed of aluminum and has an outer diameter of 46 mm. For the elastic layer 462*b*, a heat resistant rubber material such as silicone rubber or fluorine rubber is appropriately used. In this embodiment, the elastic layer 462*b* is a member that is formed of silicone rubber and has a thickness of 2 mm. The surface hardness of the second fixing roller 462 thus configured is 68 degrees (Asker C hardness).

A second fixing roller-side thermistor 466 is arranged around the circumferential surface of the winding portion (heating nip region) of the second fixing roller 462, at which the second fixing belt 464 is wound, to detect the temperature of the circumferential surface of the second fixing belt 464 wound around the second fixing roller 462.

The second pressure roller 463 is opposite to and in pressure-contact with the second fixing roller 462 with the second fixing belt 464 interposed therebetween, and is driven to rotate in a rotation direction J around the rotation axis by a drive motor (not shown). The second fixing belt 464 and the second fixing roller 462, and the second pressure roller 463 rotate reversely with respect to each other. The second pressure roller 463 has a three-layered structure in which a core metal 463*a*, an elastic layer 463*b*, and a release layer 463*c* are formed in this order from inside. For the core metal 463*a*, for example, a metal such as iron, stainless steel, aluminum, or copper, or an alloy thereof is used. In this embodiment, the core metal 463*a* is a member that is formed of aluminum and has an outer diameter of 46 mm. For the elastic layer 463*b*, a heat-resistance rubber material such as silicone rubber or fluorine rubber is appropriately used. In this embodiment, the elastic layer 463*b* is a member that is formed of silicone rubber and has a thickness of 2 mm. For the release layer 463*c*, fluorine resin such as PFA or PTFE is appropriately used. In this embodiment, the release layer 463*c* is a member that is formed of PFA and has a thickness of about 30 μm. The surface hardness of the second pressure roller 463 thus configured is 75 degrees (Asker C hardness).

The second pressure roller 463 is provided with a second heater lamp 463*d* (for example, rated power 400 W) for heating the second pressure roller 463, in an interior thereof. A control circuit (not shown) causes power to be supplied (energized) from the power supply circuit (not shown) to the second heater lamp 463*d*, the second heater lamp 463*d* emits light, and infrared rays are radiated from the second heater lamp 463*d*. Thus, the inner circumferential surface of the second pressure roller 463 absorbs the infrared rays and is heated, such that the entire second pressure roller 463 is heated. A second pressure roller-side thermistor 467 is arranged on the circumferential surface of the second pressure roller 463 to detect the temperature of the circumferential surface of the second pressure roller 463 in a contact manner.

The second fixing roller 462 and the second pressure roller 463 have an outer diameter of 50 mm and come into pressure-contact with each other by an elastic member (spring member) (not shown) with a predetermined load (in this case, 550 N). Thus, the fixing nip region is formed between the circumferential surface of the second fixing belt 464 which is supported around the second fixing roller 462 and the second heating section 461 with tension, and the circumferential surface of the second pressure roller 463. The fixing nip region refers to a region where the second fixing belt 464 and the second pressure roller 463 come into contact with each other. In this embodiment, the fixing nip region is 8 mm.

The control circuit serving as a temperature control section controls energization to the heat generating layer 310 and the second heater lamp 463*d* through the power supply circuit on the basis of temperature data detected by the respective thermistors 465, 466, and 467, such that the heat radiating member 210 of the second heating section 461, the second fixing belt 464, and the second pressure roller 463 are at a predetermined temperature.

In the fixing device 440 including the first fixing section 450 and the second fixing section 460, as described in Japanese Unexamined Patent Publication JP-A 2005-352389, control is performed such that the temperature of the second fixing section 460 is controlled so as to compensate for the changes in temperature of the first fixing section 450 (referred to as "gloss compensation mode"), whereby substantially uniform image gloss is obtained when the sheet passes successively therethrough (successive fixing processing).

First, the relational expression about temperature between the first fixing belt 454 and the second fixing belt 464 is calculated in advance such that a plurality of output images have substantially uniform gloss. That is, the temperature of the second fixing belt 464 is controlled so as to be at temperature calculated by the relational expression with respect to the change in temperature of the first fixing belt 454, such that images with uniform gloss are obtained, regardless of the temperature of the first fixing roller 452.

The temperature control section of the first fixing section 450 calculates the difference (T1−T2) between the surface temperature T1 of the first fixing belt 454 detected by the first fixing roller-side thermistor 456 and a target temperature set value T2 of the first fixing belt 454 as a temperature change value α of the first fixing belt 454. When the temperature change value α exceeds a temperature ripple for temperature control of the first fixing belt 454 when the sheet does not pass therethrough, control by the gloss correction temperature control mode is performed. When a target set temperature of the second fixing belt 464 is referred to as T4, in the gloss correction temperature control mode, temperature control of the second fixing belt 464 is performed by means of a value (T4+β), which is obtained by adding a temperature correction value β of the second fixing belt 464 to the target set temperature T4 of the second fixing belt 464. The temperature control section of the second fixing section 460 substitutes the surface temperature (T2+α) of the first fixing belt 454 into the relational expression to calculate the control temperature (T4+β) of the second fixing belt 464 and then performs temperature control. The gloss correction temperature control mode ends when the successive fixing processing ends or when the temperature change value α of the first fixing belt 454 is equal to or lower than a predetermined value, and control by the normal mode is carried out.

Figure 16:
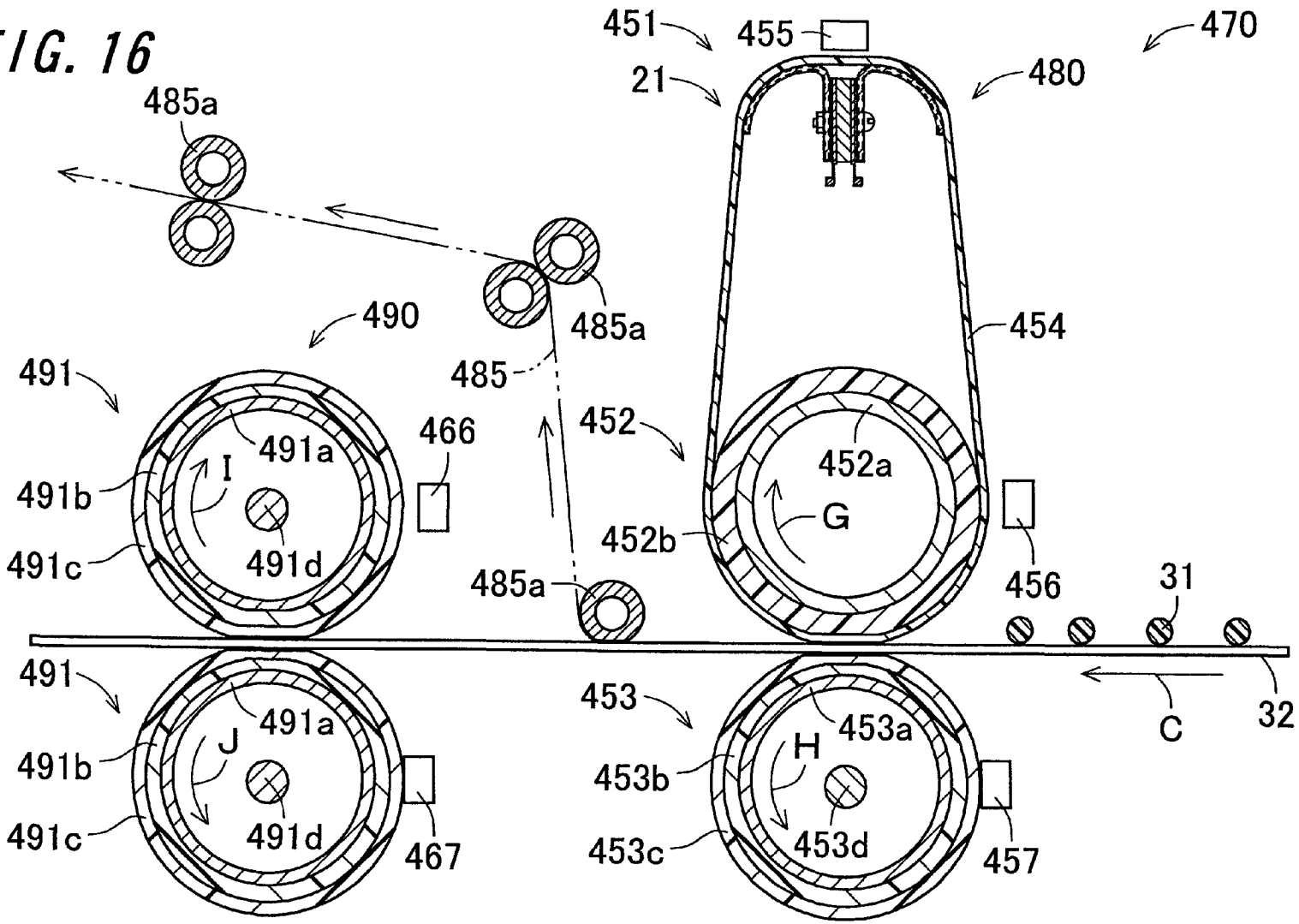
FIG. 16 is a view showing the configuration of a fixing device according to a third embodiment of the invention.

FIG. 16 is a view showing the configuration of a fixing device 470 according to a third embodiment of the invention. The fixing device 470 is a fixing device of two-stage fixing type, and includes a first fixing section 480 that performs primary fixing of the unfixed toner images 31 onto the recording paper sheet 32 under application of heat and pressure, and a second fixing section 490 that performs secondary fixing of the toner image 31 after the primary fixing onto the recording paper sheet 32 under application of heat and pressure, the second fixing section being configured by a pair of heating and pressure rollers 491 that are provided with a heating section in an interior thereof, and are in pressure-contact with each other, and being arranged on the downstream side in the conveyance direction of the recording paper sheet 32 with respect to the first fixing section 480. The first fixing section 480 and the second fixing section 490 are arranged side by side in the horizontal direction. In the fixing device 470, the first fixing section 480 is the above-described fixing device 15 that includes the heating member in which the heat radiating member having the meandering capillary tube heat pipes is provided to be in contact with the plurality of surfaces of the heat generating member.

In the fixing device 470 of two-stage fixing type thus configured, when the resistance heat generating element provided in the first fixing section 480 is energized, a uniform temperature distribution on the surface of the heat transfer section of the heat radiating member provided in the first fixing section 480 is achieved. Therefore, a uniform temperature distribution in the width direction and the circumferential direction of the fixing belt 454 is achieved, and heat generation by the resistance heat generating element is stably carried out, such that heat generation efficiency is prevented from being deteriorated. For this reason, the fixing device 470 of two-stage fixing type can obtain a high-quality fixed image and can reduce the warm-up time.

A guide member, such as a transport guide plate or a transport roller, is provided between the first fixing section 480 and the second fixing section 490. The recording paper sheet 32, which is subjected to fixing in the fixing nip region of the first fixing section 480, is transported along the guide member, subjected to fixing in the fixing nip region of the second fixing section 490, and discharged. The fixing device 470 can be mounted in the image forming apparatus 100, instead of the fixing device 15.

The first fixing section 480 provided in the fixing device 470 has the same configuration as the first fixing section 450 provided in the above-described fixing device 440, and thus description thereof will be omitted. The second fixing section 490 provided in the fixing device 470 is a fixing section of roller fixing type. In the second fixing section 490, a pair of heating and pressure rollers 491 are in pressure-contact with each other to form the fixing nip region. The respective rollers rotate reversely with respect to each other.

The pair of heating and pressure rollers 491 each have a three-layered structure in which a core metal 491*a*, an elastic layer 491*b*, and a release layer 491*c* are formed in this order from inside. For the core metal 491*a*, for example, a metal such as iron, stainless steel, aluminum, or copper, or an alloy thereof is used. For the elastic layer 491*b*, a heat resistant rubber material such as silicone rubber or fluorine rubber is appropriately used. For the release layer 491*c*, fluorine resin such as PFA or PTFE is appropriately used.

The pair of heating and pressure rollers 491 are respectively provided with a heater lamp 491*d* for heating the pair of heating and pressure rollers 491, in an interior thereof. A control circuit (not shown) causes power to be supplied (energized) from a power supply circuit (not shown) to the heater lamps 491*d*, the heater lamps 491*d* emit light, and infrared rays are radiated from the heater lamps 491*d*. Thus, the inner circumferential surfaces of the heating and pressure rollers 491 absorb the infrared ray and are heated, such that the entire heating and pressure rollers 491 are heated. The configuration for heating the heating and pressure rollers 491 is not limited to that described above, an induction heating method using induction heating may be used or a heater lamp and an induction heating method may be appropriately combined.

In the fixing device 470 including the first fixing section 480 and the second fixing section 490, the first fixing section 480 has a mechanism that is capable of carrying out rapid heating, and the second fixing section 490 has a large heat capacity.

In the fixing device 470 thus configured, the first fixing section 480 is warmed up in advance. Then, when rising is satisfactory, and a copy operation should be rapidly carried out, after the recording paper sheet 32 passes through the fixing nip region of the first fixing section 480 and subjected to fixing, the recording paper sheet 32 is conveyed to a bypass route 485 through the guide member and discharged by a plurality of conveying rollers 485*a* provided in the bypass route 485. In this case, the recording paper sheet 32 is subjected to fixing only by the first fixing section 480. When the recording paper sheet 32 is thin paper, in the same manner as described above, fixing may be carried out only by the first fixing section 480.

Meanwhile, when the recording paper sheet 32 is thick paper, to improve image gloss or to improve the fixing speed, the recording paper sheet 32, which is subjected to fixing in the fixing nip region of the first fixing section 480, may be transported along the guide member and further subjected to fixing in the fixing nip region of the second fixing section 490. As described above, when fixing is carried out in the fixing nip regions of the first fixing section 480 and the second fixing section 490, fixing performance and image gloss can be improved.

Figure 17:
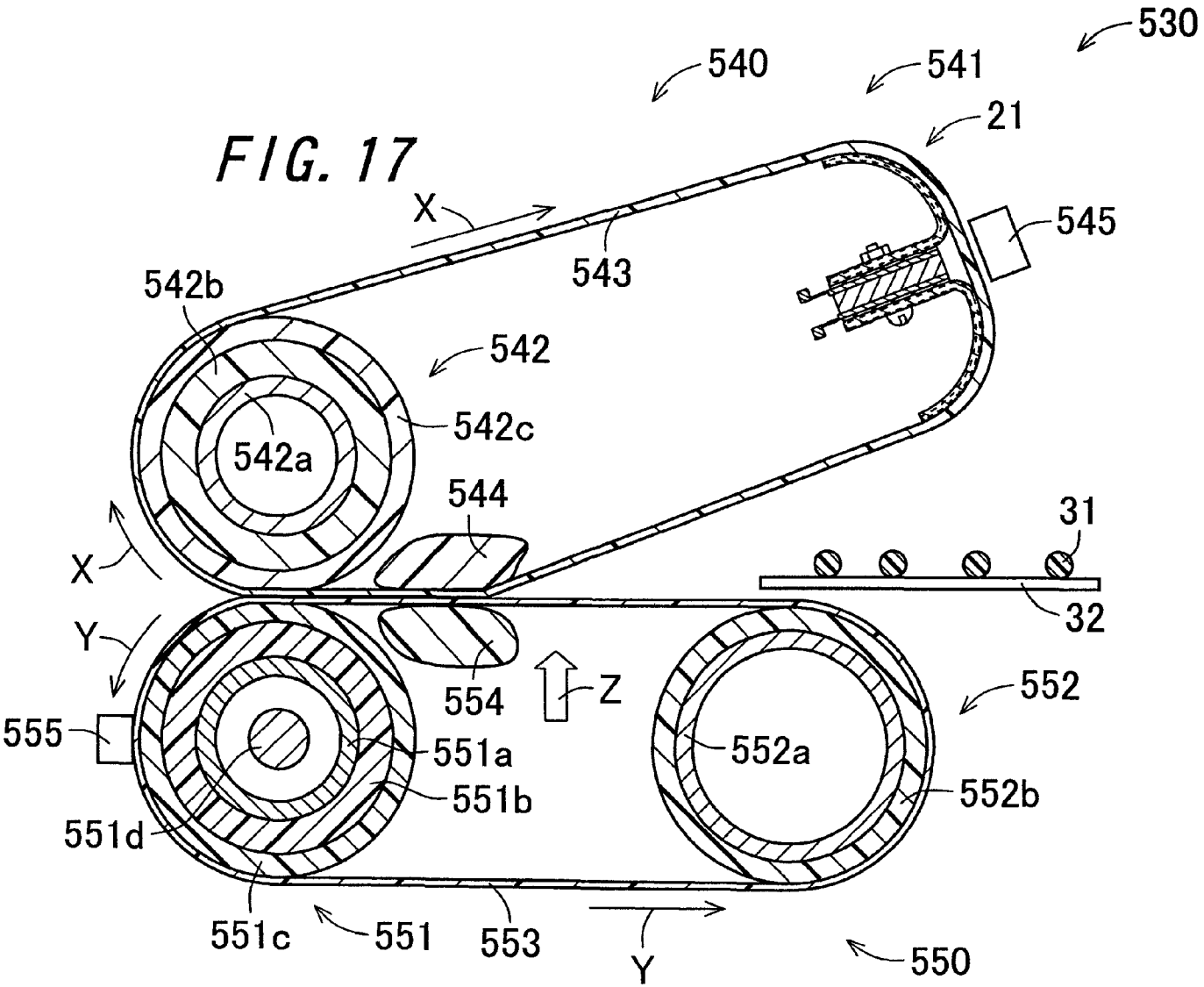
FIG. 17 is a view showing the configuration of a fixing device according to a fourth embodiment of the invention.

FIG. 17 is a view showing the configuration of a fixing device 530 according to a fourth embodiment of the invention. The fixing device 530 includes a fixing section 540 and a pressure section 550. The fixing device 530 carries out fixing on the recording paper sheet 32 on which the unfixed toner images 31 are borne, in a fixing nip region which is formed between the fixing section 540 and the pressure section 550. The fixing device 530 can be mounted in the image forming apparatus 100, instead of the fixing device 15.

The fixing section 540 includes a heating section 541, a fixing roller 542, and a fixing belt 543 which is an endless-shaped belt. In the fixing section 540, the fixing belt 543 is supported around the fixing roller 542 and the heating section 541 with tension.

The heating section 541 has the above-described heating member 21 in which the heat radiating member having the meandering capillary tube heat pipe is provided to be in contact with the plurality of surfaces of the heat generating member. The heat radiating member of the heating member 21 comes into contact with the fixing belt 543 at the heat transfer section and transfers heat generated by the heat generating layer 212 to the fixing belt 543.

A heating element-side thermistor 545 is arranged around the circumferential surface of the fixing belt 543 wound around the heating section 541 to detect the temperature of the circumferential surface in a non-contact manner.

The fixing roller 542 is a roller-like member, having an outer diameter of 30 mm, which is driven to rotate in a rotation direction X around the rotation axis by a drive motor (not shown), thereby conveying the fixing belt 543. The fixing roller 542 has a three-layered structure in which a core metal 542*a*, an elastic layer 542*b*, and a surface layer 542*c* are formed in this order from inside. For the core metal 542*a*, for example, a metal having high thermal conductivity such as iron, stainless steel, aluminum, or copper, or an alloy thereof is used. The shape of the core metal 542*a* may be a cylinder or a column, and the shape of the core metal 542*a* is preferably a cylinder since the amount of heat generation is small. For the elastic layer 542*b*, a heat-resistance rubber material such as silicone rubber, fluorine rubber, or fluorosilicone rubber, is appropriately used. Among them, silicone rubber is preferably used which is excellent in rubber elasticity.

The material for the surface layer 542*c* is not particularly limited insofar as heat resistance and durability are excellent and slidability is high. For example, a fluorine-based resin material such as PFA or PTFE, or fluorine rubber may be used. Alternatively, a two-layered structure excluding the surface layer may be provided. A heating section for heating the fixing roller 542 may be provided inside the fixing roller 542. This is to reduce the rising time from when the image forming apparatus 100 is powered-on until image formation is possible, and to suppress a decrease in the surface temperature of the fixing roller 542 due to heat transfer to the recording paper sheet 32 at the time of toner image fixing.

The fixing belt 543 is heated to a predetermined temperature by the heating section 541, and comes into contact with the fixing belt 543 to heat the conveyed recording paper sheet 32 on which the unfixed toner images 31 are formed. The fixing belt 543 which is an endless-shaped belt, is supported around the heating section 541 and the fixing roller 542, and wound around the fixing roller 542 at a predetermined angle. When the fixing roller 542 rotates, the fixing belt 543 is driven by rotation of the fixing roller 542 and rotates in the rotation direction X. The fixing belt 543 is provided to come into contact with a pressure belt 553 at a pressure-contact region between the fixing roller 542 and a pressure roller 551 described below.

The fixing belt 543 is an endless-shaped belt that has a three-layered structure consisting of a substrate layer, an elastic layer, and a release layer. The fixing belt 543 is formed to have a cylindrical shape of a diameter of 60 mm and a thickness of 270 μm. The material for the substrate layer is not particularly limited insofar as heat resistance and durability are excellent, and heat-resistance synthetic resins may be used. Among them, polyimide (PI) or polyamide-imide resin (PAI) is preferably used. These resins have high strength and high heat resistance as well as are inexpensive. The thickness of the substrate layer is not particularly limited and preferably, 30 to 200 μm. In this embodiment, the substrate layer is formed of polyimide and has a thickness of 100 μm.

The material for the elastic layer is not particularly limited insofar as the material has rubber elasticity, and preferably, the material is also excellent in heat resistance. Specific examples of such a material include, silicone rubber, fluorine rubber, and fluorosilicone rubber. Among them, silicone rubber, which is excellent in rubber elasticity and has satisfactory heat resistance, is preferably used. The surface hardness of the elastic layer is preferably in a range of 1 to 60 degrees based on the JIS-A hardness scale. When the surface hardness of the elastic layer is within this range based on the JIS-A hardness scale, deterioration of the strength of the elastic layer and defective adhesion can be prevented, and defective fixability of toner can be prevented. Specific examples of silicone rubber having such properties include one-component, two-component, or three or more-component silicone rubber, LTV, RTV, or HTV-type silicone rubber, and condensation or addition-type silicone rubber. The thickness of the elastic layer is preferably in a range of 30 to 500 μm. When the thickness of the elastic layer is within this range, the elastic effect of the elastic layer can be maintained, and thermal insulation can be minimized, thereby achieving power savings. In this embodiment, the elastic layer is formed of silicone rubber having hardness of 5 degrees based on the JIS-A hardness scale and a thickness of 150 μm.

The release layer is formed of a fluorine resin tube. The release layer formed on the outer circumference of the fixing belt 543 is formed of a fluorine resin. Thus, the release layer is excellent in durability, as compared with a release layer, which is formed by applying and baking resin containing fluorine resin. When a release layer is formed by application and baking, an accurate and expensive mold is required so as to a release layer with high dimension accuracy. Meanwhile, when a tube is used, even when the above-described mold is used, a release layer with high dimension accuracy is obtained. The thickness of the release layer is preferably in a range of 5 to 50 μm. When the thickness of the release layer is within this range, the release layer can be fine unevenness of the recording paper sheet 32 while having appropriate strength and ensuring elasticity of the elastic layer. In this embodiment, the release layer is formed of a PTFE tube having a thickness of about 20 μm.

Next, the pressure section 550 will be described. The pressure section 550 includes a pressure roller 551, a tension roller 552, and a pressure belt 553 which is an endless-shaped belt. In the pressure section 550, the pressure belt 553 is supported around the pressure roller 551 and the tension roller 552 with tension. The pressure roller 551 and the tension roller 552 are rotatably supported axially between left and right side plates (not shown) of the fixing device 530.

The pressure belt 553 is configured in the same manner as the above-described fixing belt 543, and is driven to rotate by rotation of the fixing belt 543 in contact with the pressure belt 553.

The pressure roller 551 is a roller-like member that is rotated in a rotation direction Y around the rotation axis by rotation of the pressure belt 553, which is rotated by rotation of the fixing belt 543. The pressure roller 551 has an outer diameter of 30 mm. The pressure roller 551 has a three-layered structure in which a core metal 551*a*, an elastic layer 551*b*, and a surface layer 551*c* are formed in this order from inside. As the materials for the core metal 542*a*, the elastic layer 551*b*, and the surface layer 551*c* of the pressure roller 551, the same materials as those for the core metal 542*a*, the elastic layer 542*b*, and the surface layer 542*c* of the above-described fixing roller 542 may be used. The pressure roller 551*a* is provided with a heating section 551*d* for heating the pressure roller 551, in an interior thereof. This is to reduce the rising time from when the image forming apparatus 100 is powered-on until image formation is possible, and to suppress a rapid decrease in the surface temperature of the pressure roller 551 due to heat transfer to the recording paper sheet 32 at the time of toner image fixing. In this embodiment, for the heating section 551*d*, a halogen lamp is used.

The tension roller 552 is configured such that a silicone sponge layer 552*b* is provided on an iron-ally core metal 552*a* having an outer diameter of 30 mm and an inner diameter of 26 mm so as to decrease thermal conductivity, thereby decreasing thermal conduction from the pressure belt 553.

The fixing device 530 is a so-called twin-belt fixing type fixing device in which a fixing nip region is formed at a region where the fixing belt 543 and the pressure belt 553 come into contact with each other, and fixing is carried out at the fixing nip region. In the fixing device 530, a pressure-contact region where the fixing roller 542 and the pressure roller 551 come into pressure-contact with each other with the fixing belt 543 and the pressure belt 553 interposed therebetween becomes the lowermost stream portion of the fixing nip region. Of the entire fixing nip region formed at the portion where the fixing belt 543 and the pressure belt 553 are in contact with each other, the lowermost stream portion is a portion where the pressure distribution in the conveyance direction of the recording paper sheet becomes the maximum. As described above, by making the configuration such that the pressure distribution at the lowermost stream portion of the fixing nip region becomes the maximum, the fixing belt 543 and the pressure belt 553 can be prevented from slipping at the time of rotation.

The fixing device 530 is also provided with a fixing pad 544 and a pressure pad 554 so as to ensure a wide fixing nip region, without increasing the size of the device. The fixing pad 544 serves as a first pressure pad that presses the fixing belt 543 toward the pressure belt 553. The pressure pad 554 serves a second pressure pad that presses the pressure belt 553 toward the fixing belt 543. The fixing pad 544 and the pressure pad 554 are arranged to be supported between left and right side plates (not shown) of the fixing device 530. The pressure pad 554 is pressed toward the fixing pad 544 with a predetermined pressing force in a direction Z close to the fixing pad 544 by a pressing mechanism (not shown). As the materials for the fixing pad 544 and the pressure pad 554, PPS (polyphenylene sulfide resin) may be used.

When the fixing nip region is formed by the fixing pad 544 and the pressure pad 554 which are not rotators, the inner circumferential surfaces of the fixing belt 543 and the pressure belt 553 frictionally slide on the respective pads. Then, when the friction coefficient between the inner circumferential surfaces of the respective belts 543 and 553 and the respective pads 544 and 554 increases, slide resistance increases. As a result, image slippage, gear damages, an increase in power consumption of the drive motor, and the like occur. In particular, in the twin-belt system, these problems become conspicuous. For this reason, low friction sheet layers are provided on the contact surfaces of the fixing pad 544 and the pressure pad 554 with the respective belts 543 and 553. Therefore, the respective pads 544 and 554 can be prevented from being abraded due to friction to the respective belts 543 and 553, and slide resistance can be reduced. As a result, satisfactory belt running property and durability are obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device comprising:

a first fixing member;

a heating member;

a fixing belt that forms an endless-shaped belt member supported around the first fixing member and the heating member with tension to be rotatable, and comes into contact with the heating member to be heated; and a second fixing member that forms a fixing nip region together with the fixing belt, the fixing device fixing a toner image borne on a recording medium onto the recording medium in the fixing nip region under application of heat and pressure, the heating member including:

a heat generating member that has a heat generating layer composed of a resistance heat generating element that generates heat due to being energized; and a heat radiating member that radiates heat generated by the heat generating member to the fixing belt, the heat radiating member having:

a heat receiving section that is provided to be in contact with a plurality of surfaces of the heat generating member and receive heat generated by the heat generating member; and a heat transfer section that is provided to be curved along the inner circumferential surface of the fixing belt and transfers heat received by the heat receiving sections to the fixing belt, and inside the heat receiving section and the heat transfer section, a heat transport section being provided to transport heat received by the heat receiving section toward the heat transfer section in a width direction and a circumferential direction of the fixing belt.

2. The fixing device of claim 1, wherein the heat transport section includes a meandering capillary tube heat pipe in which a capillary tube filled with a heat transport fluid is repeatedly bent to form a predetermined surface, and the capillary tube includes linear portions that extend linearly, and connection portions that connect ends of adjacent linear portions in an extension direction of the linear portion to form a single line.

3. The fixing device of claim 2, wherein the heat transport section is configured by a combination of two or more meandering capillary tube heat pipes selected from the group consisting of a meandering capillary tube heat pipe in which the extension direction of the linear portions is in parallel to the width direction of the fixing belt, a meandering capillary tube heat pipe in which the extension direction of the linear portions is orthogonal to the width direction of the fixing belt, and a meandering capillary tube heat pipe in which the extension direction of the linear portions is inclined at a predetermined angle in the width direction of the fixing belt.

4. The fixing device of claim 1, wherein the heat receiving section is provided to be in contact with two surfaces having a larger area in descending order from among surfaces constituting the heat generating member and to sandwich the heat generating member.

5. The fixing device of claim 1, wherein the heat radiating member includes a plurality of heat radiating sections having the heat transport section, and the plurality of heat radiating sections each include a heat receiving piece that receives heat generated by the heat generating member, the heat receiving pieces of the plurality of heat radiating sections being provided to be in contact with different surfaces of the heat generating member, the plurality of heat radiating sections each include a heat transfer piece that is provided to be curved along the inner circumferential surface of the fixing belt and transfers heat received by the heat receiving pieces to the fixing belt, and the heat receiving pieces of the plurality of heat radiating sections are combined with each other to form the heat receiving section, and the heat transfer pieces of the plurality of heat radiating sections are combined with each other to form the heat transfer section.

6. The fixing device of claim 1, wherein a heat generating region of the resistance heat generating element is of a planar shape.

7. The fixing device of claim 1, wherein the resistance heat generating element is a ceramic heat generating element.

8. The fixing device of claim 1, wherein the resistance heat generating element has a positive resistance-temperature property in which, as temperature rises, electric resistance increases.

9. The fixing device of claim 1, wherein the resistance heat generating element has a negative resistance-temperature property in which, as temperature rises, electrical resistance decreases.

10. The fixing device of claim 1, wherein the resistance heat generating element has a positive resistance-temperature property and a negative resistance-temperature property.

11. The fixing device of claim 1, wherein the heat generating layer has a plurality of rectangular resistance heat generating elements arranged in the width direction of the fixing belt.

12. The fixing device of claim 1, wherein the heat generating member has a plurality of heat generating layers having a plurality of rectangular resistance heat generating elements arranged in the width direction of the fixing belt with an intermediate layer interposed therebetween, and the resistance heat generating elements constituting the plurality of heat generating layers are arranged in a staggered manner when viewed from a direction orthogonal to the width direction of the fixing belt.

13. The fixing device of claim 1, wherein a slide easing layer that reduces frictional resistance to the fixing belt is provided on a surface of the heat transfer section that is in contact with the fixing belt.

14. The fixing device of claim 13, wherein the slide easing layer is formed of a material having a low friction coefficient and satisfactory thermal conductivity.

15. The fixing device of claim 1, wherein the second fixing member includes a pressure belt that is an endless-shaped belt that is supported around a pressure member and a support member with tension to be rotatable, and the pressure member is provided to be opposite to the first fixing member with the fixing belt and the pressure belt interposed therebetween.

16. A fixing device of two-stage fixing type comprising:

a first fixing section that performs primary fixing of a toner image borne on a recording medium to be conveyed onto the recording medium under application of heat and pressure; and a second fixing section that is arranged on a downstream side in a conveyance direction of the recording medium with respect to the first fixing section, and performs secondary fixing of the toner image after the primary fixing onto the recording medium under application of heat and pressure, the first fixing section and the second fixing section being the fixing device of claim 1.

17. An image forming apparatus comprising the fixing device of claim 16.

18. A fixing device of two-stage fixing type comprising:

a first fixing section that performs primary fixing of a toner image borne on a recording medium to be conveyed onto the recording medium under application of heat and pressure; and a second fixing section that performs secondary fixing of toner image after the primary fixing onto the recording medium under application of heat and pressure, the second fixing section being configured by a pair of heating and pressure rollers that are provided with a heating section in an interior thereof, and are in pressure-contact with each other, and being arranged on a downstream side in a conveyance direction of the recording medium with respect to the first fixing section, the first fixing section being the fixing device of claim 1.

19. An image forming apparatus comprising the fixing device of claim 16.

20. An image forming apparatus comprising the fixing device of claim 1.

* * * * *